US008666265B2

(12) United States Patent
Ishihara et al.

(10) Patent No.: US 8,666,265 B2
(45) Date of Patent: Mar. 4, 2014

(54) IMAGE FORMING APPARATUS AND IMAGE FORMING METHOD OF ELECTROPHOTOGRAPHY

(75) Inventors: Takahiro Ishihara, Maebashi (JP); Tomohisa Itagaki, Abiko (JP); Nobuhiko Zaima, Kashiwa (JP); Yasuhito Shirafuji, Kashiwa (JP)

(73) Assignee: Canon Kabushiki Kaisha (JP)

( * ) Notice: Subject to any disclaimer, the term of this patent is extended or adjusted under 35 U.S.C. 154(b) by 220 days.

(21) Appl. No.: 13/366,922

(22) Filed: Feb. 6, 2012

(65) Prior Publication Data

US 2012/0201554 A1 Aug. 9, 2012

(30) Foreign Application Priority Data

Feb. 9, 2011 (JP) ..... 2011-025885

(51) Int. Cl.
*G03G 15/00* (2006.01)
*G03G 15/043* (2006.01)

(52) U.S. Cl.
USPC ..... 399/15; 399/49; 399/51

(58) Field of Classification Search
USPC ..... 399/9, 11, 15, 46, 49, 72
See application file for complete search history.

(56) References Cited

U.S. PATENT DOCUMENTS 7,920,800 B2 * 4/2011 Nakazato et al. ..... 399/49
7,974,544 B2 * 7/2011 Kobayashi et al. ..... 399/49

FOREIGN PATENT DOCUMENTS

JP 2004101564 A 4/2004

* cited by examiner

*Primary Examiner* — Hoang Ngo
(74) *Attorney, Agent, or Firm* — Rossi, Kimms & McDowell LLP

(57) ABSTRACT

An image forming apparatus that is capable of reducing a sequential variation of graininess and keeping imaging quality. An exposure unit exposes the photoconductor to a light beam to form an electrostatic latent image. A development unit develops the electrostatic latent image with a toner. A change unit changes a height of toner image by changing an exposure spot area of the light beam on the photoconductor. A formation unit forms test patterns corresponding to different exposure spot areas on a recording sheet. A read unit reads the test patterns. A control unit detects graininess of each test pattern based on information about the test patterns read by the read unit, determines an exposure spot area where the graininess becomes good relatively, and controls the height of toner image on the photoconductor by setting the exposure spot area determined so as to be an exposure spot area for image formation.

9 Claims, 31 Drawing Sheets

IMAGE FORMING APPARATUS AND IMAGE FORMING METHOD OF ELECTROPHOTOGRAPHY

BACKGROUND OF THE INVENTION

1. Field of the Invention

The present invention relates to image forming apparatuses, such as a copier, a multifunctional peripheral device, and a printer. Particularly, the present invention relates to an image forming apparatus and an image forming method of electrophotography using photoconductor.

2. Description of the Related Art

A copier and a laser beam printer of the electrophotography are known as image forming apparatuses of a high speed and a high definition digital system. In recent years, such an image forming apparatus is spreading out not only into an office or a home but into a commercial print market, and higher definition of an image forming apparatus is requested.

There are various important image quality items, such as color reproducibility, gradation reproducibility, dot-line reproducibility, and graininess, when considering characteristic of an output image quality of an image forming apparatus. The graininess among the image quality items is inconsistency in densities (variation) of dots that constitute a halftone image. The graininess is a particularly important image quality item, because it has large effect on the reproducibility of photo image quality and the image appears to be rough when the graininess deteriorates.

Although the granularity is initially determined by an initial condition of the image formation in the electrophotography system, it varies according to environmental variation or time degradation of configuration members. Therefore, the method of controlling the sequential variation of the granularity of an image forming apparatus is proposed (for example, see Japanese Laid-Open Patent Publication (Kokai) No. 2004-101564 (JP2004-101564A)).

The technique described in JP2004-101564A reads information about the inconsistency in density of a developed toner image by a light reflex type sensor, and calculates an index showing the graininess. Then, when at least one of a variation of the inconsistency in density or a variation of the density of an image exceeds a tolerance level, the technique decreases the inconsistency in density by combining a first control factor that improves the graininess with increasing toner deposit and a second control factor that improves the graininess with increasing toner deposit.

For example, as described in FIG. 20 of JP2004-101564A, electric potential of an electrostatic latent image area (developing bias) is changed as the first control factor, and linear velocity ratio of a developing roller to a photoconductor is changed as the second control factor. Although an average toner deposit increases as the developing bias increases, the graininess deteriorates simultaneously. In other words, when the developing bias becomes small, the average toner deposit decreases and the graininess improves simultaneously. Although the average toner deposit increases as the linear velocity ratio of the developing roller increases, the graininess improves. Therefore, JP2004-101564A describes that the average toner deposit and the graininess (the inconsistency in density of an image) are controllable independently by controlling the developing bias and the linear velocity ratio of the developing roller suitably.

Incidentally, the conventional image forming apparatus of the electrophotography system forms an electrostatic latent image on a uniformly electrified photoconductor by exposing selectively based on image data, and forms a toner image on the photoconductor by developing the electrostatic latent image with toner. The toner image formed on the photoconductor is transferred to a recording sheet, and the image is formed by fixing the toner image to the recording sheet in a fixing process after transferring.

Such an image forming apparatus removes the toner that is not transferred and remains on the photoconductor by contacting a cleaning member, such as a cleaning blade, to the photoconductor in order to scrape the toner off after image formation. Therefore, friction between the photoconductor and such a cleaning member over the long term chips the surface of the photoconductor gradually, which reduces film thickness of the photoconductor (photoconductor thickness).

According to investigation, the inventors of the present invention found a phenomenon in which the graininess of an outputted image deteriorated by reduction of the photoconductor thickness. Since the technique described in the patent publication does not take the photoconductor thickness into consideration as a control factor as mentioned above, deterioration of the graininess by reduction in the photoconductor thickness cannot be controlled. Since the technique described in the patent publication controls the two control factors simultaneously or sequentially, there is a problem of taking time until optimizing the graininess.

SUMMARY OF THE INVENTION

The present invention provides an image forming apparatus and an image formation method that are capable of reducing a sequential variation of the graininess and keeping imaging quality over a long period of time.

Accordingly, a first aspect of the present invention provides an image forming apparatus comprising a photoconductor, an exposure unit configured to exposes the photoconductor to a light beam to form an electrostatic latent image on the photoconductor, a development unit configured to develop the electrostatic latent image with a toner, a change unit configured to change a height of toner image formed on a surface of the photoconductor by changing an exposure spot area of the light beam on the surface of the photoconductor, a formation unit configured to control the exposure unit, the development unit, and the change unit so that a plurality of test patterns, corresponding to different exposure spot areas respectively, are formed on a recording sheet, a read unit configured to read the plurality of test patterns formed on the recording sheet, and a control unit configured to detect graininess of each of the plurality of test patterns based on information about the plurality of test patterns read by the read unit, to determine an exposure spot area where the graininess becomes good relatively, and to control the height of the toner image on the photoconductor by setting the exposure spot area determined so as to be an exposure spot area for image formation.

Accordingly, a second aspect of the present invention provides an image forming method executed in an image forming apparatus that is provided with a photoconductor, an exposure unit that exposes the photoconductor to a light beam to form an electrostatic latent image on the photoconductor, and a development unit that develops the electrostatic latent image with a toner, the image forming method comprising a formation step of controlling the exposure unit and the development unit so that a plurality of test patterns, corresponding to different exposure spot areas respectively, are formed on a recording sheet, a read step of reading the plurality of test patterns formed on the recording sheet in the formation step, a detection step of detecting graininess of each of the test patterns read in the read step, and a control step of determining an exposure spot area where the graininess becomes good relatively, and controlling a height of toner image formed on a surface of the photoconductor at the time of image formation by setting the exposure spot area determined so as to be an exposure spot area for image formation.

According to the image forming apparatus and the image formation method of the present invention, the sequential variation of the graininess is reduced and the imaging quality is kept over a long period of time.

Further features of the present invention will become apparent from the following description of exemplary embodiments with reference to the attached drawings.

DESCRIPTION OF THE EMBODIMENTS

Hereafter, an image forming apparatus according to the present invention will be described with reference to accompanying drawings. First, a story leading up to the present invention will be described.

Figure 1:
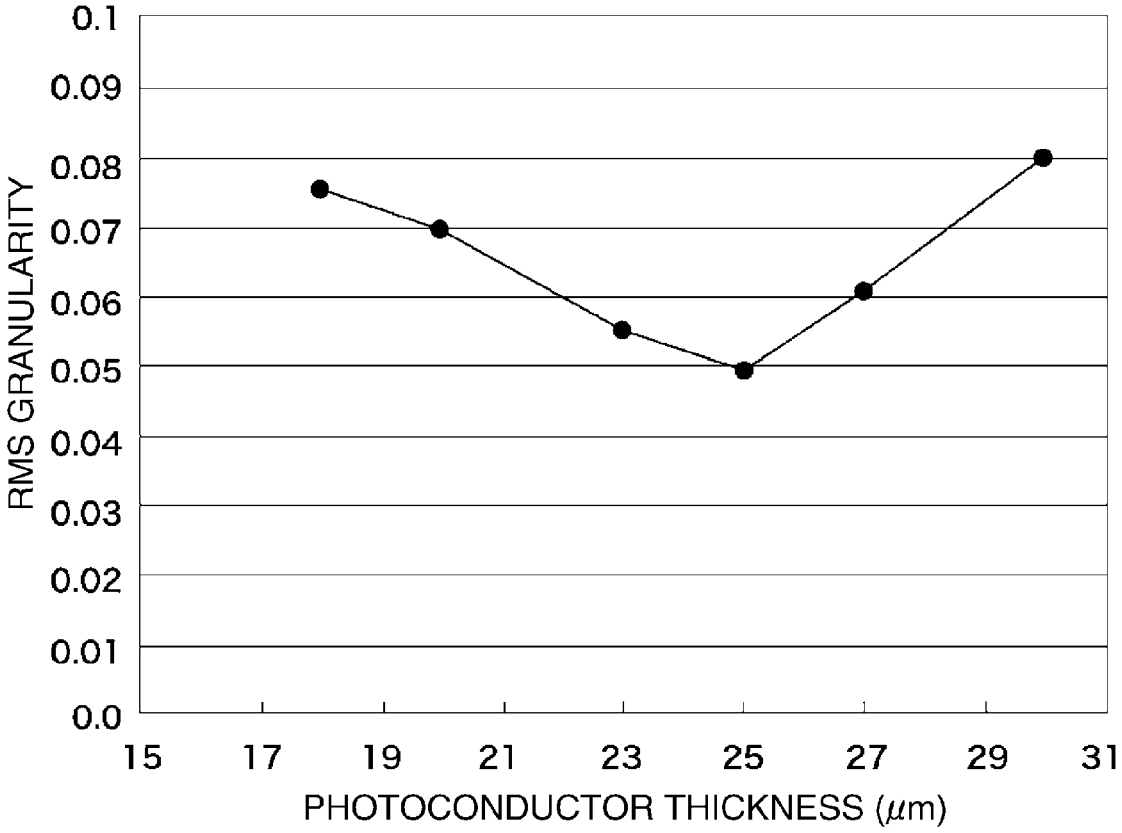
FIG. 1 is a graph showing relation between photoconductor thickness and RMS (root mean square) granularity that is an index showing graininess.

As mentioned above, the inventors of the present invention found that reduction in a photoconductor thickness has effect on a phenomenon in which graininess of an outputted image deteriorated, as a result of investigation. Here, the graininess is evaluated by calculating granularity. FIG. 1 is a graph showing relation between photoconductor thickness and RMS granularity that is an index showing the graininess. The RMS granularity is an index for standardizing graininess, and is standardized by ANSI PH-2.40-1985. The RMS granularity is given by standard deviation of density distribution of an image, and is calculated by the following expression. In this expression, "Di" denotes density distribution and "Dav" denotes average density.

$$\text{RMS}\cdot\text{granularity}\sigma_D = \sqrt{\frac{1}{N}\sum_{i=1}^{N}(Di - Dav)^2}$$

The graininess deteriorates as the value of the RMS granularity becomes larger. That is, when the RMS granularity becomes high, the image appears to be rough visually. Therefore, a high definition image can be formed by controlling the RMS granularity small.

As an evaluation expression for converting the graininess into numbers, the evaluation expression using the Granularity valuation function, the evaluation expression by Dooley and Shaw that uses Wiener Spectrum and VTF, etc. are known. The granularity indexes obtained by these expressions and the RMS granularity have mutual correlations.

As shown in FIG. 1, the graininess improves with decreasing film thickness in a range where the photoconductor thickness is equal to or larger than 25 μm, but the graininess deteriorates with decreasing film thickness in a range where the photoconductor thickness is smaller than 25 μm.

The improvement of the graininess with the decreasing film thickness in the range where the photoconductor thickness is equal to or larger than 25 μm can be described as improvement of reproducibility of an outputted image with respect to image data by getting a latent image profile sharp. The latent image profile is potential distribution of an electrostatic latent image.

Figure 2:
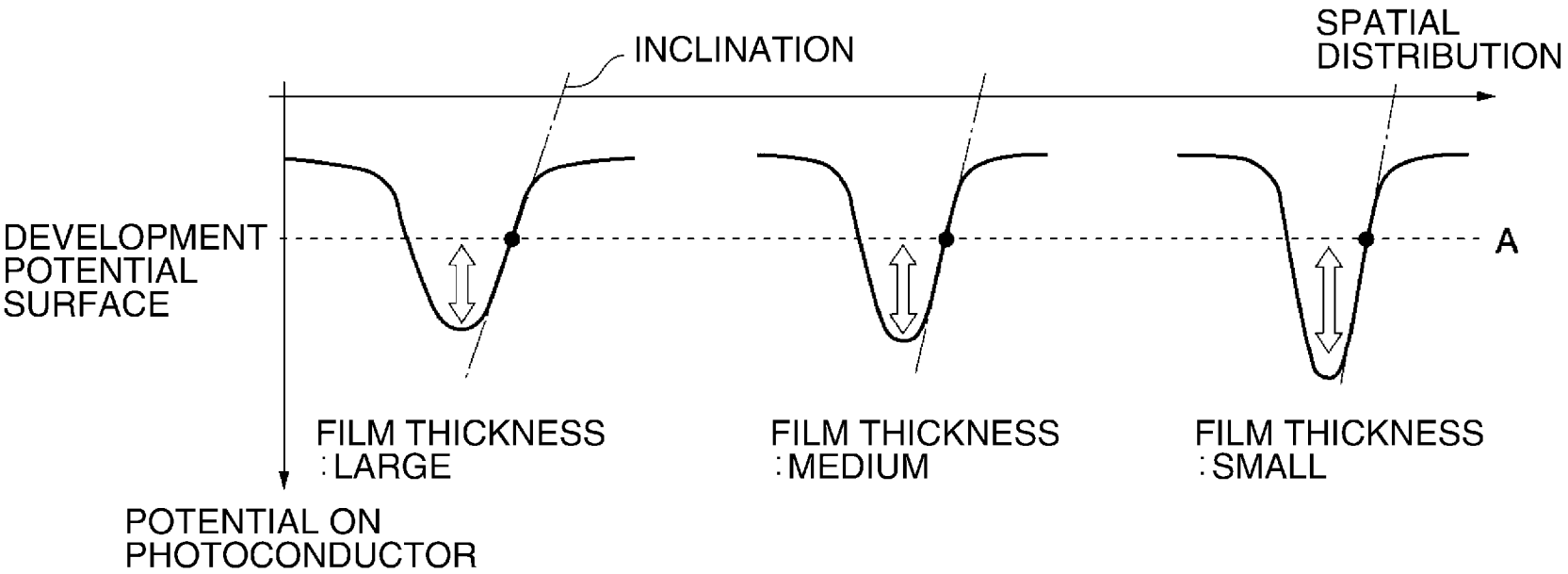
FIG. 2 is a view showing latent image profiles formed when electrified photoconductors of the same material and of different thickness are exposed by a light of the same light amount.

FIG. 2 is a view showing latent image profiles formed when electrified photoconductors of the same material and of different thickness are exposed by a light of the same light amount. A segment A shown in FIG. 2 denotes a development potential surface. The development potential surface is a surface equipotential to voltage (direct current) applied to a toner bearing member. The amount of toner developed is determined according to charge quantity per one particle of toner, and difference between electric potential of an electrostatic latent image and the development potential surface.

As shown in FIG. 2, when the photoconductor thickness decreases, the latent image profile gets sharp. That is, an inclination of the latent image profile on the development potential surface becomes large, and depth of the latent image with respect to the development potential surface increases. Here, the inclination of the latent image profile on the development potential surface is defined as an absolute value of the inclination at an intersection with the development potential surface of the latent image profile.

For example, in the case of a stacked photoconductor (described later) shown in FIG. 4, a carrier generated in a charge generation layer 22 is injected into a charge transfer layer 21, moves to the photoconductor surface along an electric field in the photoconductor, neutralizes the surface potential of the photoconductor, and forms an electrostatic latent image. In the stacked photoconductor, electric field intensity in the photoconductor can be increased by decreasing the film thickness of the charge transfer layer 21. Decreasing of diffusion length of the carrier controls diffusion of the carrier in a direction perpendicular to the electric field in the photoconductor, and enables to form a latent image profile that is faithful to an exposure profile and sharp.

When an effect of the sharpness of the latent image profile (i.e., the inclination of the latent image profile on the development potential surface and the depth thereof with respect to the development potential surface) to a process to develop an electrostatic latent image by toner is considered, force to draw the toner to the electrostatic latent image increases as the inclination and the depth increase. Since this faithfully develops the electrostatic latent image by the toner and reduces the diffusion of the toner at an edge of a toner image formed on the photoconductor, the toner image that has high reproducibility to image data can be formed. Thus, in the range where the photoconductor thickness is equal to or larger than 25 μm, when the latent image profile gets sharp, the electrostatic latent image is faithfully developed by the toner, the reproducibility of the outputted image to image data improves.

However, in the range where the photoconductor thickness is smaller than 25 μm, even when the latent image profile gets sharp, the graininess deteriorates. The inventors of the present invention analyzed this issue. As a result, it became clear that the sharpness of the latent image profile with decreasing photoconductor thickness increases a height of toner image that constitutes one dot of a halftone image on the photoconductor, which becomes weak in resisting disorders in the transfer process and the fixing process (details will be described later). It is considered that this results because electrostatic constraining force from the photoconductor to the toner stacked on an upper portion of the toner layer is weak and such a toner becomes unstable dynamically.

Since the conventional image forming apparatus of the electrophotography system was not able to prevent the deterioration of the graininess owing to the increasing height of toner image, it was difficult to prevent the deterioration of the graininess owing to the decreasing photoconductor thickness.

In order to solve this problem, a method of detecting variation of the photoconductor thickness and changing the height of toner image according to the variation of the photoconductor thickness can be considered. However, since the effect of the height of toner image on the graininess varies with an environmental condition or an endurance condition in the transfer process and the fixing process, it is difficult to predict the optimal height of toner image based on the photoconductor thickness.

There is change in resistance of a transfer member due to environmental variation as an example of the environmental condition or the endurance condition that affects the height of toner image in the transfer process and the fixing process. In low-temperature/low-humidity ambient environment, since the resistance of the transfer member becomes high, a transfer bias increases. In this case, since the electric field spreads to a transfer nip upstream part strongly, electricity is easily discharged, which increases the scattering of the toner in a transfer unit. This transfers the toner to a transferred target unevenly and deteriorates the graininess of an outputted image.

Thus, the ease of scattering of toner varies with the environmental variation. And since the ease of scattering of toner has deep relation with the height of toner image, the effect of the height of toner image on the graininess varies with the environmental condition. Therefore, in order to keep the graininess of the outputted image good, it is necessary to control the height of toner image so as to be optimal for the environmental condition and the endurance condition at the time of image formation.

The image forming apparatus of the present invention enables to keep the graininess of the outputted image good even if the height of toner image varies with the variation of the photoconductor thickness or the height of toner image in the transfer unit etc. that affects the graininess varies with the variation of the environmental condition. Details will be described later.

Outlines of a system configuration and an image forming process of the image forming apparatus that is common to the first, second, and third embodiments (described later) will be described.

Figure 3:
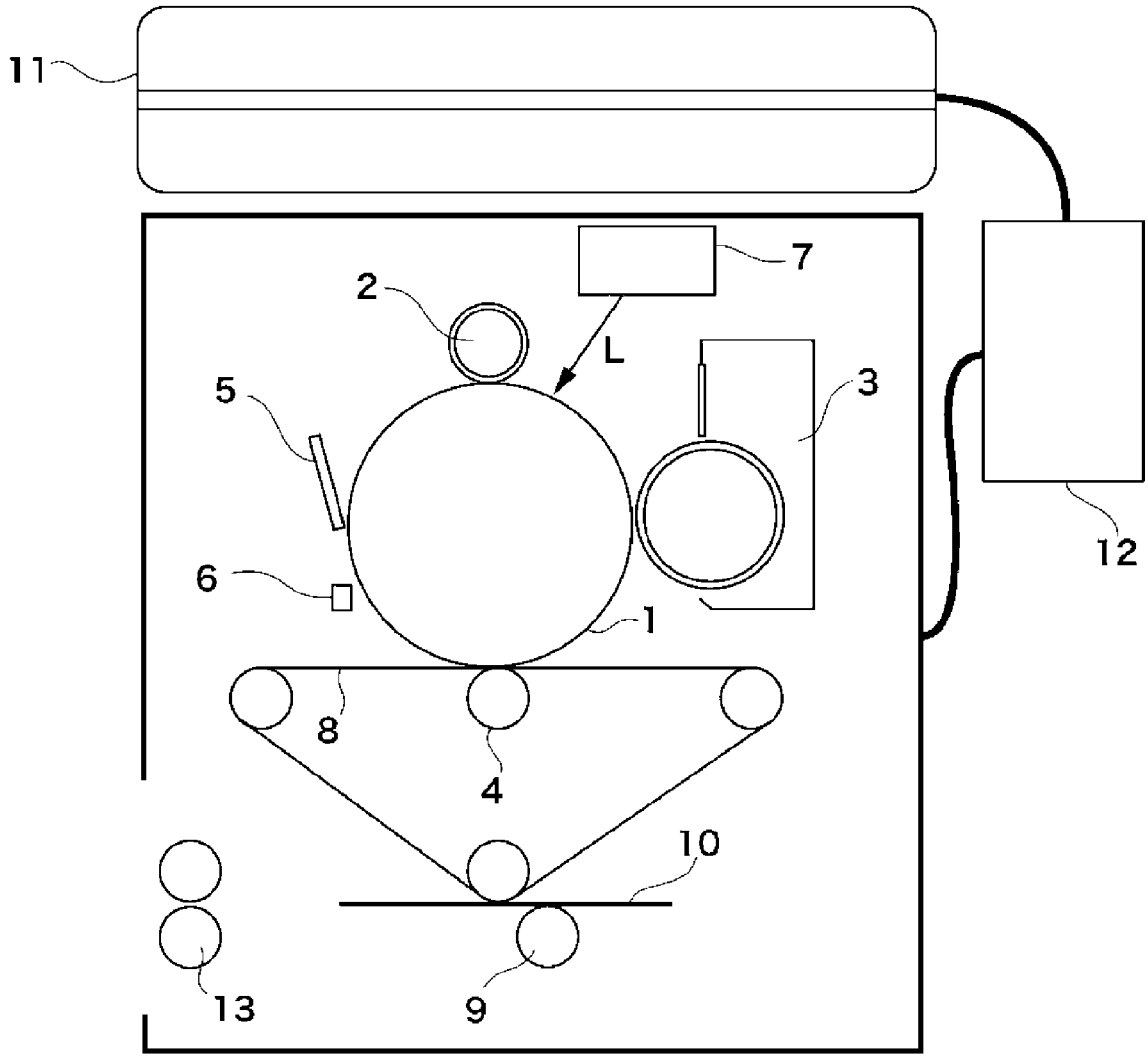
FIG. 3 is a view schematically showing a configuration of an image forming apparatus according to an embodiment of the present invention.

FIG. 3 is a view schematically showing a configuration of the image forming apparatus according to the embodiments of the present invention. The photoconductor (photosensitive drum) 1 is uniformly charged in negative polarity with a roller charging device 2. An exposure device 7, which comprises an exposure light source, an exposure-spot-area changing unit, and a scanning optical system, emits a laser beam L according to an image signal sent from a controller 12. When the laser beam L irradiates a surface of the photoconductor 1, surface potential of the photoconductor 1 is attenuated and an electrostatic latent image is formed.

The electrostatic latent image formed on the photoconductor 1 is developed as a toner image by a two-component development device 3 for developing an electrostatic latent image with toner (coloring material). The toner image formed on the photoconductor 1 is transferred by a primary transfer roller 4 onto an intermediate transfer belt 8. The toner image transferred on the intermediate transfer belt 8 is transferred by a secondary transfer roller 9 onto a recording sheet 10 (a paper sheet etc.). The toner image transferred to the recording sheet 10 is heated and pressured in a fixing unit 13, and is fixed to the recording sheet 10. Excess toner remained on the photoconductor 1 is scraped by a cleaner 5. The scraped excess toner in the cleaner 5 is conveyed and collected by a waste toner container (not shown). Then, after an electric discharge lamp 6 eliminates a history of the electric potential of the latent image on the photoconductor 1, the photoconductor 1 is again charged by the roller charging device 2, and a series of image forming processes mentioned above are repeated.

The reader 11 serves as a read unit that reads an original at the time of copying, and another read unit that reads an image of a test pattern for graininess detection in the image forming apparatus of this embodiment. The graininess is detected because the controller 12 performs data processing based on the image data read by the reader 11. That is, the reader 11 and the controller 12 constitute a graininess detection device.

Figure 4:
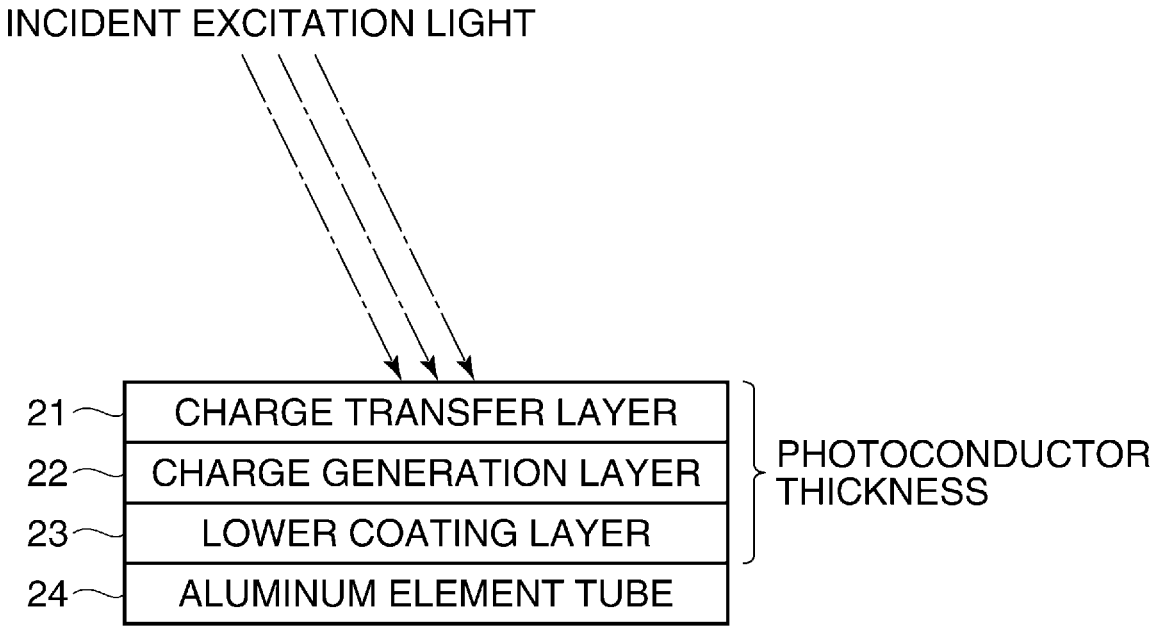
FIG. 4 is a sectional view schematically showing a configuration of a photoconductor of the image forming apparatus shown in FIG. 3.

FIG. 4 is a sectional view schematically showing the configuration of the photoconductor 1. The photoconductor 1 is a stacked photoconductor and has a three-layer configuration that consists of the charge transfer layer 21, the charge generation layer 22, and a lower coating layer 23 that are arranged sequentially from the surface of the photoconductor 1. An aluminum element tube 24, which serves as a base, is located under the lower coating layer 23. The photoconductor thickness in this embodiment means a total of the respective film thicknesses of the charge transfer layer 21, the charge generation layer 22, and the lower coating layer 23.

The charge transfer layer 21 plays a part that transfers the carrier generated in the charge generation layer 22 by an incident excitation light to the surface of the photoconductor 1. An electron hole is conveyed by the charge transfer layer 21 where the electrified polarity of the photoconductor 1 is minus. The charge generation layer 22 generates the carrier of a pair of an electron and an electron hole by light excitation. The lower coating layer 23 conveys the carrier generated by the charge generation layer 22 to the aluminum element tube 24. An electron is conveyed by the lower coating layer 23 where the electrified polarity of the photoconductor 1 is minus.

Figure 5A:
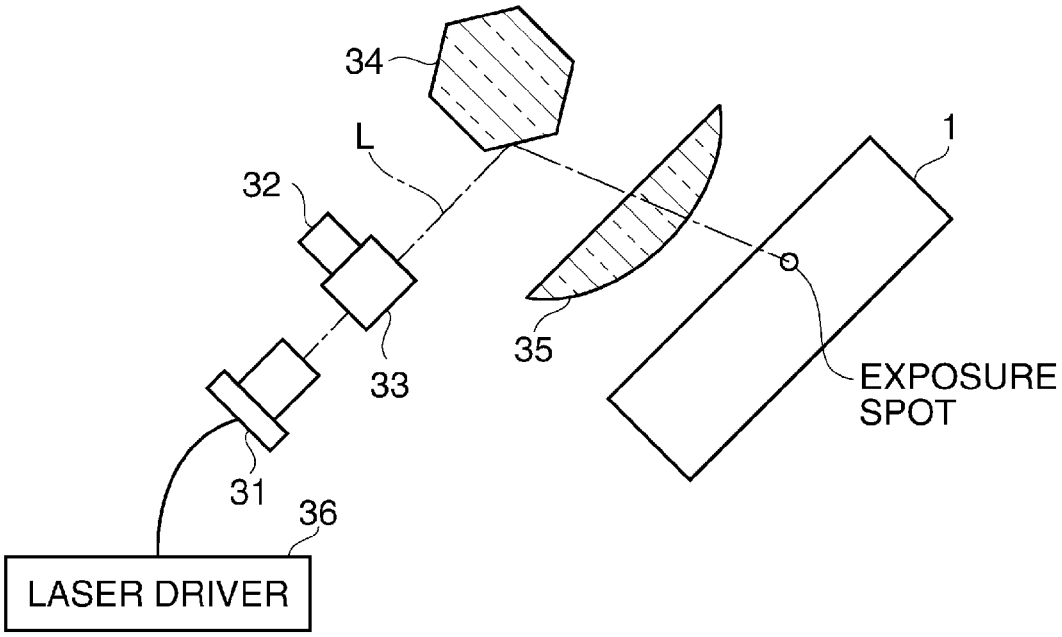
FIG. 5A is a view schematically showing a configuration of an exposure device of the image forming apparatus shown in FIG. 3.
Figure 5B:
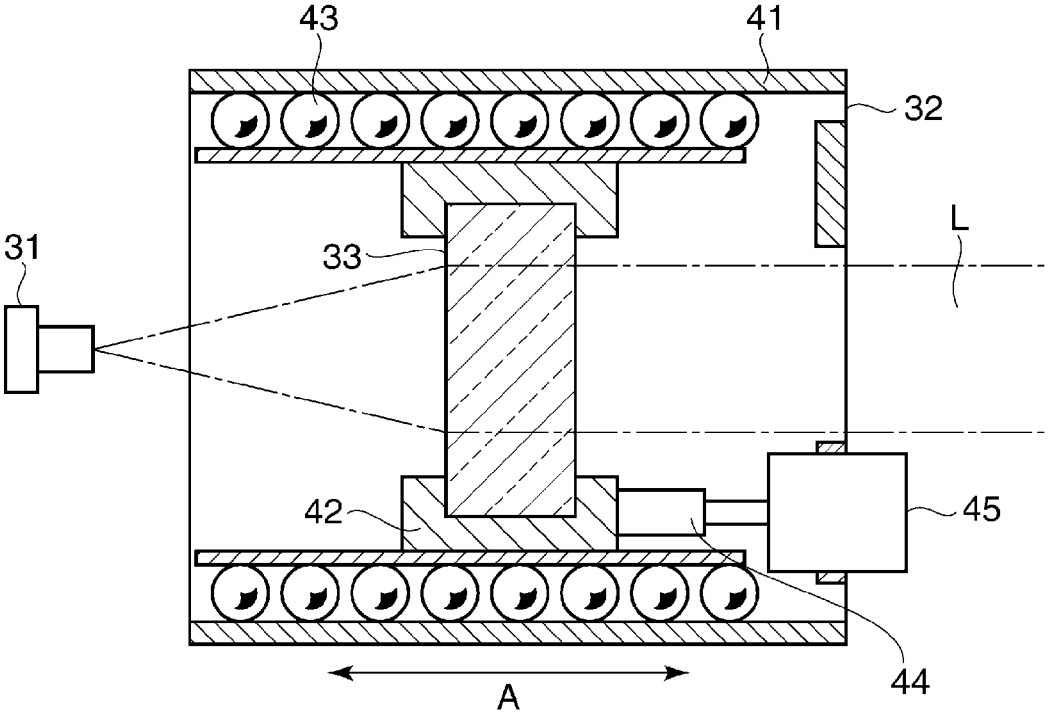
FIG. 5B is a sectional view schematically showing a configuration of a collimation optical system with which the exposure device of the image forming apparatus shown in FIG. 3 is provided.

FIG. 5A is a view schematically showing a configuration of the exposure device 7, and FIG. 5B is a sectional view schematically showing a configuration of a collimation optical system with which the exposure device 7 is provided. In FIG. 5A, the exposure light source 31 is a semiconductor laser device that emits a laser beam (a light beam) with a center wavelength of 680 nm. The laser beam L emitted from the exposure light source 31 is converted into a parallel beam through a collimator lens 33 provided with a focus adjustment mechanism 32, is reflected by a rotating polygonal mirror 34 that has six mirror surfaces around it, and is scanned. The laser beam L reflected by the rotating polygonal mirror 34 is converged by an f-θ lens 35 onto the photoconductor 1. It should be noted that a laser driver 36 that controls light-emitting timing and intensity of the laser beam is connected to the exposure light source 31.

An arrow A shown in FIG. 5B denotes a center axial direction of the laser beam. The collimator lens 33 is fixed to a cage 42 of a linear ball bearing 41 so that a focal point of the collimator lens 33 is located on a center axis of the laser beam. Rotation of stiff balls 43 that constitute the linear ball bearing 41 enables smooth, accurate, and parallel movement of the collimator lens 33 fixed to the cage 42 in the optical axis direction of the collimator lens 33 (the center axial direction of the laser beam). The cage 42 is connected with a piezoelectric actuator 45 via a guide shaft 44, and moves in parallel to the optical axis direction of the collimator lens 33 (the center axial direction of the laser beam) according to the drive by the piezoelectric actuator 45.

When the piezoelectric actuator 45 is driven according to a control signal, the collimator lens 33 supported by the linear ball bearing 41 moves in the optical axis direction. This adjusts convergence of the laser beam and changes an exposure spot area of one dot on the photoconductor 1, i.e., changes a spot diameter (referred to as an "exposure spot diameter" hereafter) corresponding to the exposure spot area of one dot. The use of the piezoelectric actuator 45 extremely increases response speed of changing the exposure spot diameter with respect to the control signal.

This embodiment assumes that light amount distribution of the exposed spot is Gaussian and the exposure spot diameter is a diameter of the light amount distribution at a level of $1/e^2$ of the peak light amount in the exposure spot. An integration profile of the exposure spot on the photoconductor 1 can be changed by changing the exposure spot diameter because the exposure spot area on the surface of the photoconductor 1 is changed.

In this embodiment, an initial set value of the exposure spot diameter shall be 40 μm. Light exposure to the photoconductor 1 can be changed by controlling the laser-light-emitting intensity of the semiconductor laser device of the exposure light source 31.

The variation of the exposure spot diameter on the photoconductor 1 with the movement of the collimator lens 33 in the optical axis direction is shown in Table 1. In this embodiment, the movement in the optical axis direction of the collimator lens 33 is adjusted so that the exposure spot diameter for which it asks may be obtained based on the translation table of the table 1 showing the relation between an exposure spot diameter and the movement of the collimator lens 33.

TABLE 1

| SPOT DIAMETER (μm) | MOVEMENT OF COLLIMATOR LENS (mm) |
|---|---|
| 40 | 0.00 |
| 45 | 0.30 |
| 50 | 0.60 |
| 55 | 0.90 |
| 60 | 1.25 |
| 65 | 1.50 |

Figure 6:
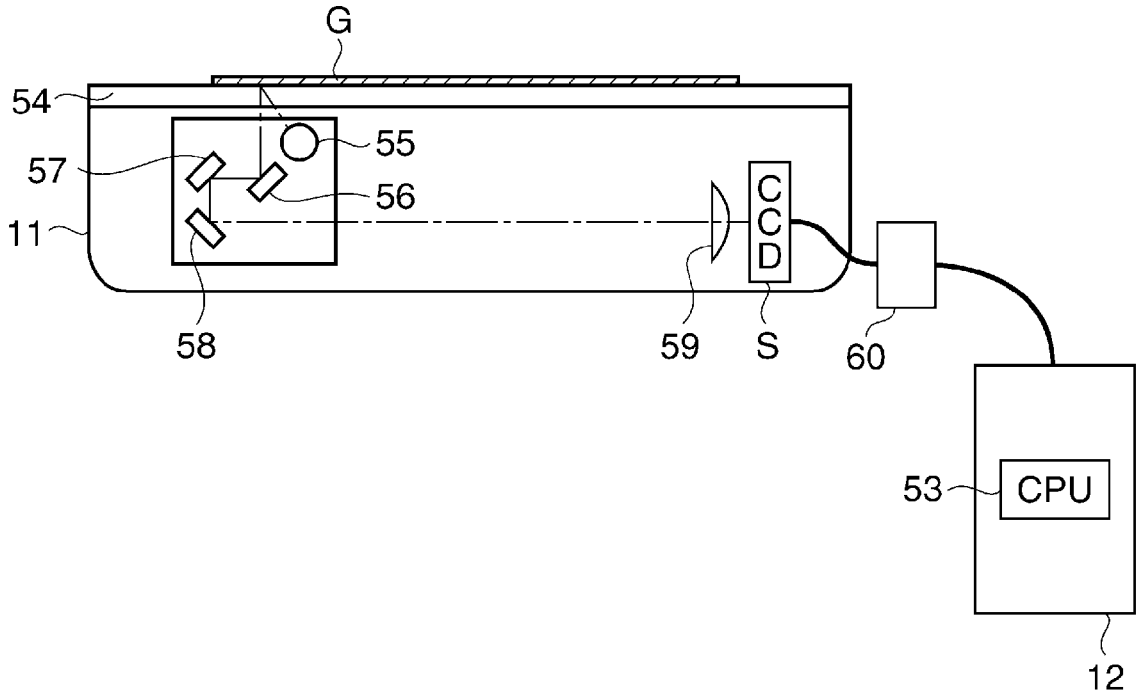
FIG. 6 is a view schematically showing a configuration of a graininess detection device (a reader and a controller).

FIG. 6 is a view schematically showing a configuration of the graininess detection device (the reader 11 and the controller 12). The graininess is detected by converting the image data of the outputted image read by the reader 11 into the RMS granularity by a central processing unit 53 of the controller 12.

The reader 11 has a configuration of an ordinary manuscript reader. That is, an original G that is held on a manuscript stand 54 (a platen glass) is irradiated with a light emitted from a lamp light source 55. The light reflected by the surface of the original G is further reflected by mirrors 56, 57, and 58, is condensed by a lens 59, and is received by a linear-type CCD sensor S. The reflected light from the surface of the original G is converted into an electrical signal from a light signal by the CCD sensor S, and is converted into multiple value image data at 600 dpi resolution by an A/D convertor 60.

The image data converted into the multiple value information at 600 dpi resolution is converted into density information for every pixel of 600 dpi by the central processing unit (CPU) 53 of the controller 12. Then, the density information is converted into the RMS granularity according to the RMS granularity expression mentioned above.

Figure 7:
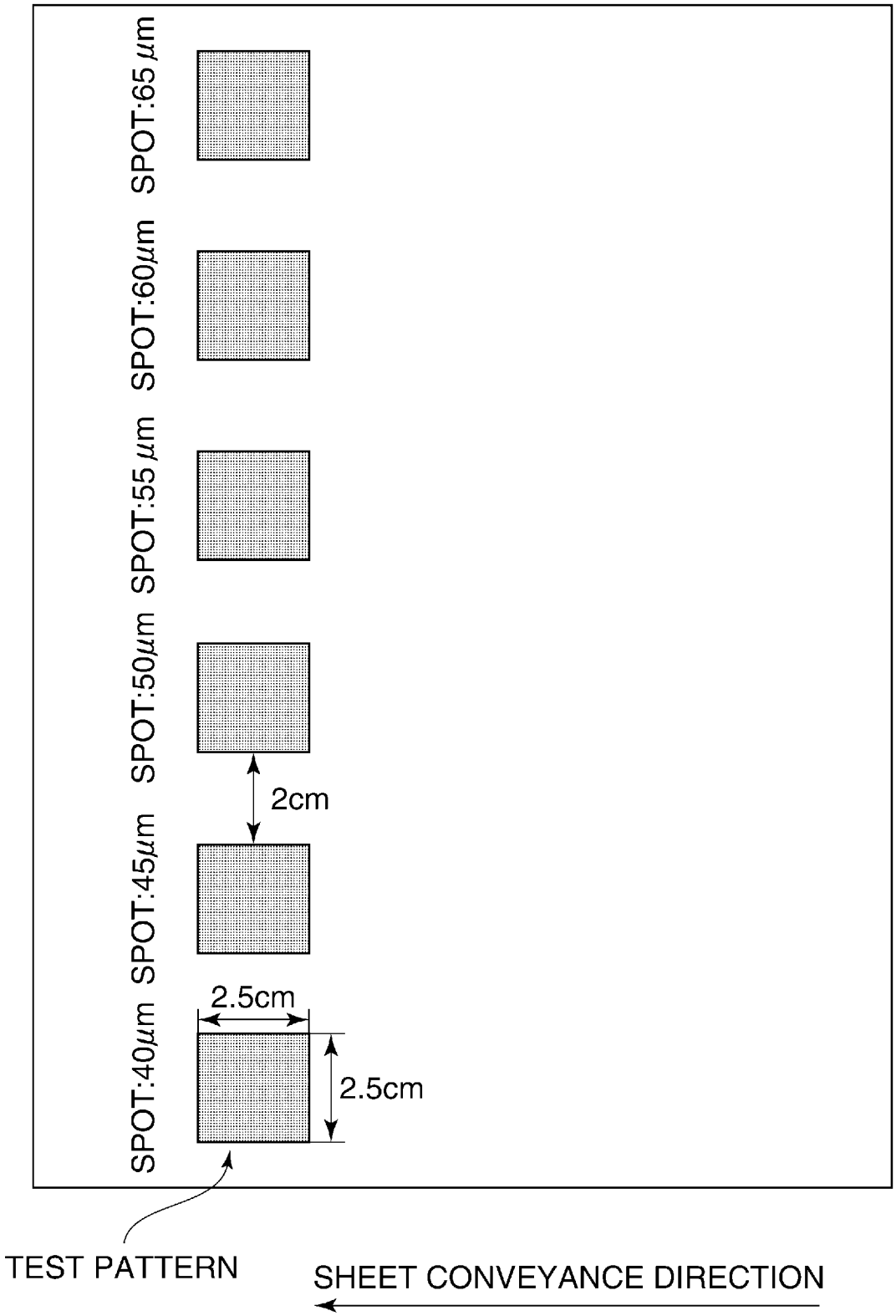
FIG. 7 is a view showing examples of test patterns for graininess measurement.

FIG. 7 is a view showing examples of test patterns for the graininess measurement. The same test patterns are aligned in an image area of a sheet of a predetermined size (here, A4 size). The number of the test patterns is equal to measurement points for the exposure spot diameter. Each test pattern has a square shape whose one side is 2.5 cm, and the interval of the patterns is 2 cm. In this embodiment, there are six measurement points for the exposure spot diameters that are changed by 5 μm within a range of 40 through 65 μm. Therefore, six test patterns are arranged corresponding to the respective exposure spot diameters. The number of lines (an arrangement of measurement points for the exposure spot area) of the test pattern is 150 lpi (lines per inch) that is equal to a screen ruling used for the image formation in this embodiment. Gradation of each test pattern is adjusted so that the average density of the output of the test pattern is nearly equal to the reflection density 0.4 (O. D.) of an intermediate gradation range that has the greatest effect on the graininess.

When the image forming apparatus goes into a calibration sequence for the height of toner image, the test patterns in FIG. 7 are outputted (printed) on an A4 sheet. That is, the exposure spot diameter is changed by 5 μm within the range of 40 through 65 μm and the six test patterns corresponding to the respective exposure spot diameters are printed in the image area of the sheet of an A4 size. The outputted test patterns (the sheet to which the patterns are printed) is arranged on the manuscript stand 54 by a user, and is read to measure the graininess.

Although the number of lines of the test pattern is 150 lpi only in this embodiment, the test patterns may have a plurality of numbers of lines when a plurality of screen rulings will be used for the image formation. In such a case, the calibration for the height of toner image can be performed for each number of lines. Although the gradation of the test pattern is adjusted so as to be nearly equal to the reflection density 0.4 (O. D.) of the intermediate gradation range that has the greatest effect on the graininess in this embodiment, the test patterns may have a plurality of gradations so that gradations in a highlight area, a shadow area, etc. that receive user's attention can be measured.

Figure 8:
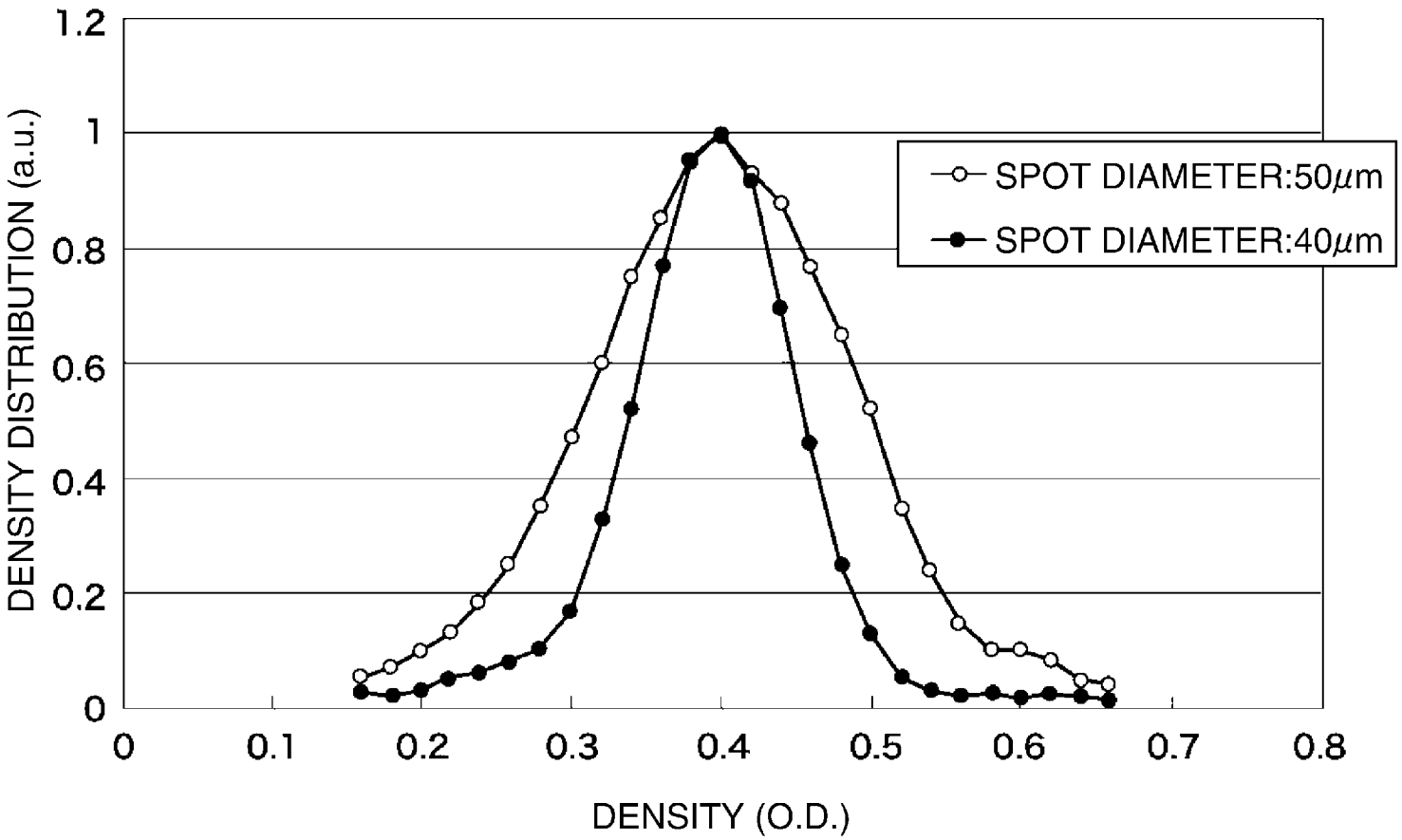
FIG. 8 is a graph showing read results of density distribution of the test patterns in FIG. 7 that are outputted with different exposure spot diameters.

FIG. 8 is a graph showing results that the reader 11 reads the density distributions of the test patterns for the exposure spot diameters of 40 μm and 50 μm among the test patterns in FIG. 7, using the image forming apparatus of this embodiment. Although the average density that is macroscopic reflection density is 0.4 (O. D) in both the cases where the exposure spot diameters are 40 μm and 50 μm, the density distributions (variations in density) are different to each other. The density distribution expresses the graininess and a user visually recognizes the variation in the density as roughness of the image.

Although the relation between the photoconductor thickness and the height of toner image was previously described briefly as the story leading up to the present invention, the effect of the photoconductor thickness on the height of toner image and the latent image profile on the photoconductor will be described again.

Figure 9:
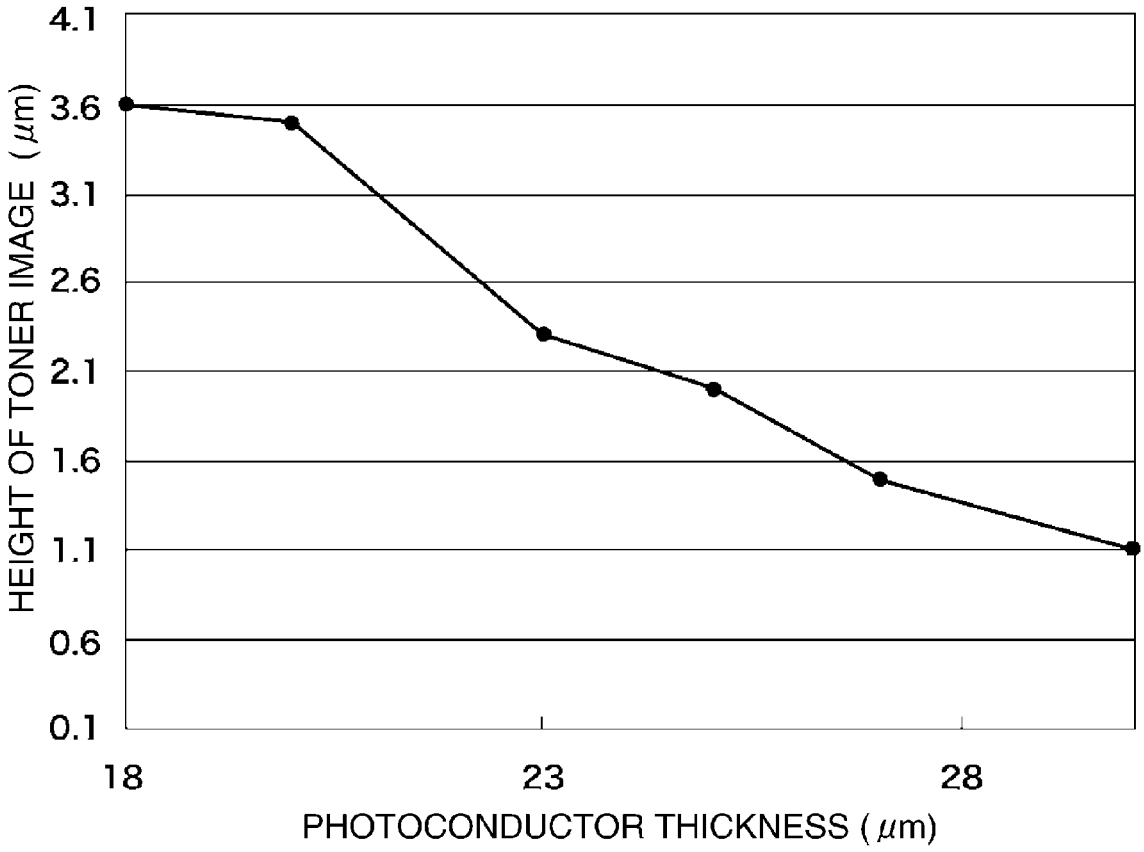
FIG. 9 is a graph showing relation between photoconductor thickness and a height of toner image of a dot that constitutes the same halftone image on the photoconductor.

First, the effect of variation of the photoconductor thickness on the height of toner image on a photoconductor, and its cause will be described. FIG. 9 is a graph showing relation between the photoconductor thickness and the height of toner image of a dot that constitutes the same halftone image on the photoconductor. As shown in FIG. 9, the height of toner image of a dot that constitutes the halftone image on the photoconductor increases with decreasing film thickness in a range where the photoconductor thickness is equal to or smaller than 25 μm.

In order to consider the cause by which the height of toner image of the dot on the photoconductor increases with decreasing photoconductor thickness, the effect of variation of the latent image profile according to reduction in the photoconductor thickness on the height of toner image will be described. Here, since it is difficult to measure the latent image profiles directly, the latent image profiles are compared by a latent image simulation based on an exposure profile, a generation process of a charge carrier and a transport process of the charge carrier within the photoconductor.

Figure 10:
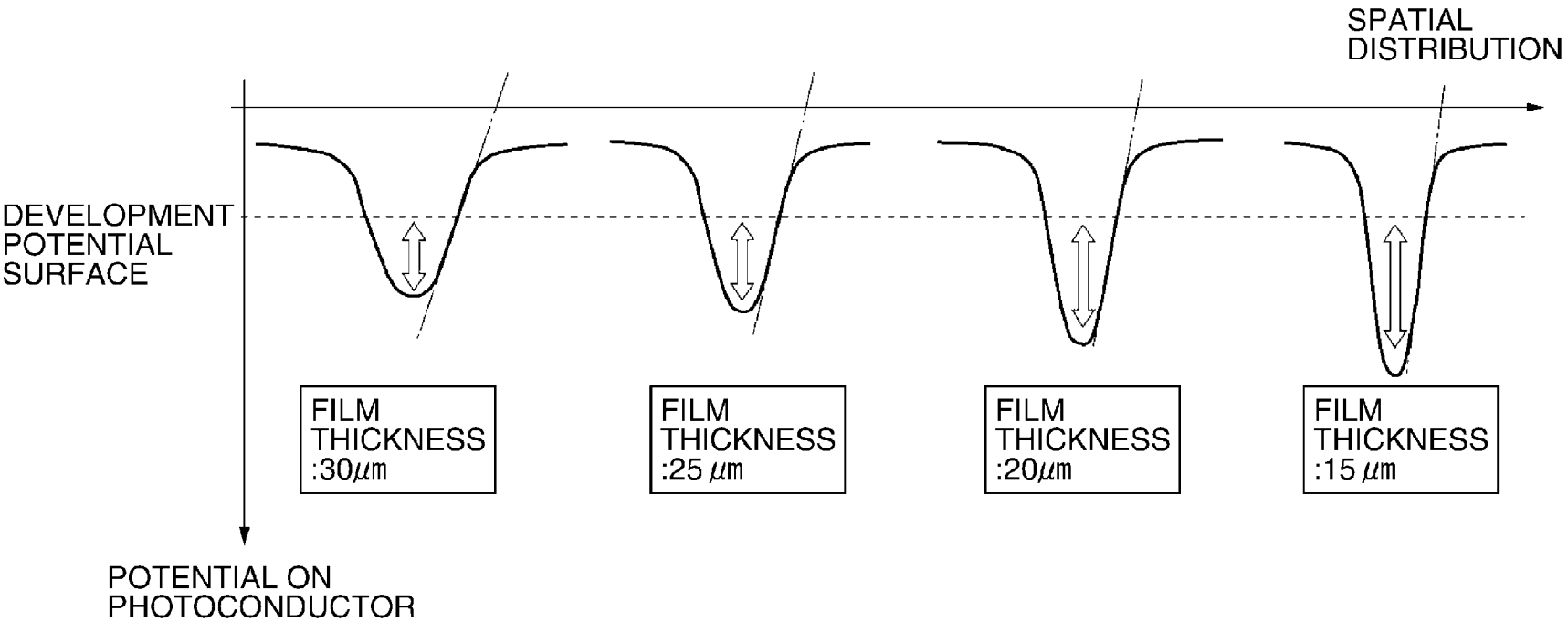
FIG. 10 is a view showing latent image profiles formed when the electrified photoconductors of the same material and of different thickness are exposed by a light of the same light amount and the same spot diameter.

FIG. 10 is a view showing the latent image profiles formed when the electrified photoconductors of the same material and of different thickness are exposed by a light of the same light amount and the same spot diameter. In FIG. 10, a vertical axis denotes the electric potential of the latent image, and the four latent image profiles are shown. The leftmost profile is formed where the photoconductor thickness is 30 μm, the next profile is for 25 μm, the next profile is for 20 μm, and the rightmost profile is for 15 μm. It should be noted that the exposing condition in the latent image simulation is determined as follows. That is, development contrast potential that unifies densities of solid black areas for the respective photoconductor thicknesses is found by experiment. Then, the development contrast potential corresponding to the solid black area is adjusted so as to become equal to the value found by the experiment.

Figure 11A:
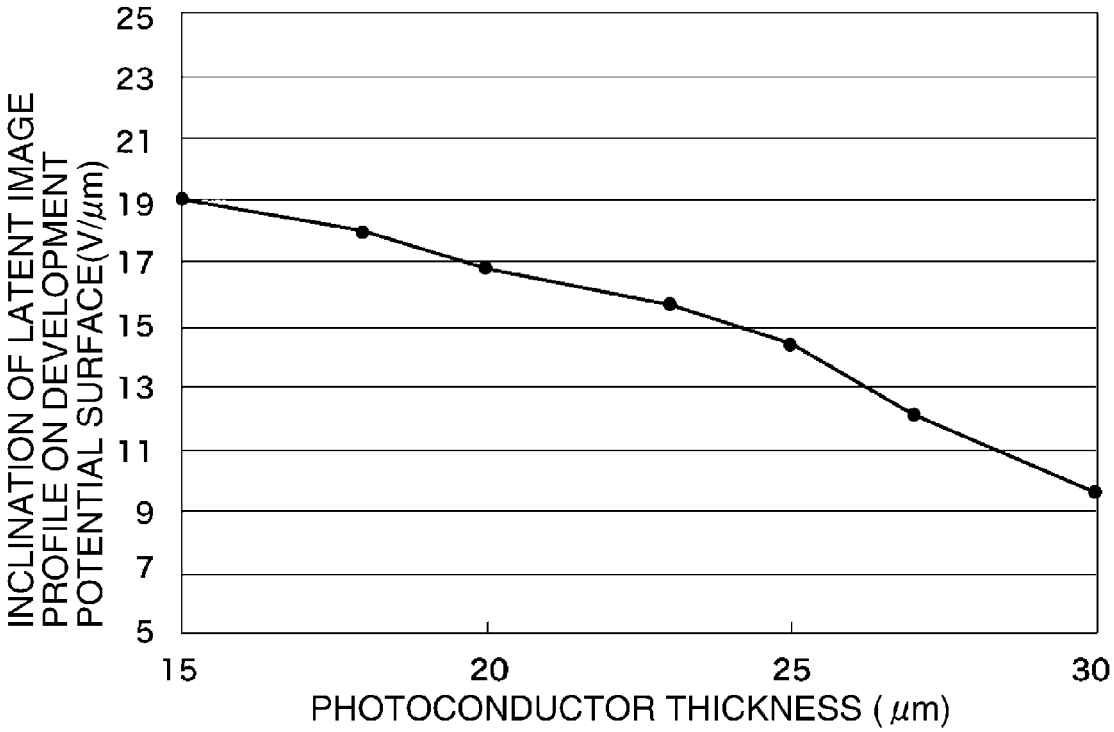
FIG. 11A is a graph showing relation between the photoconductor thickness and an inclination of the latent image profile on a development potential surface.
Figure 11B:
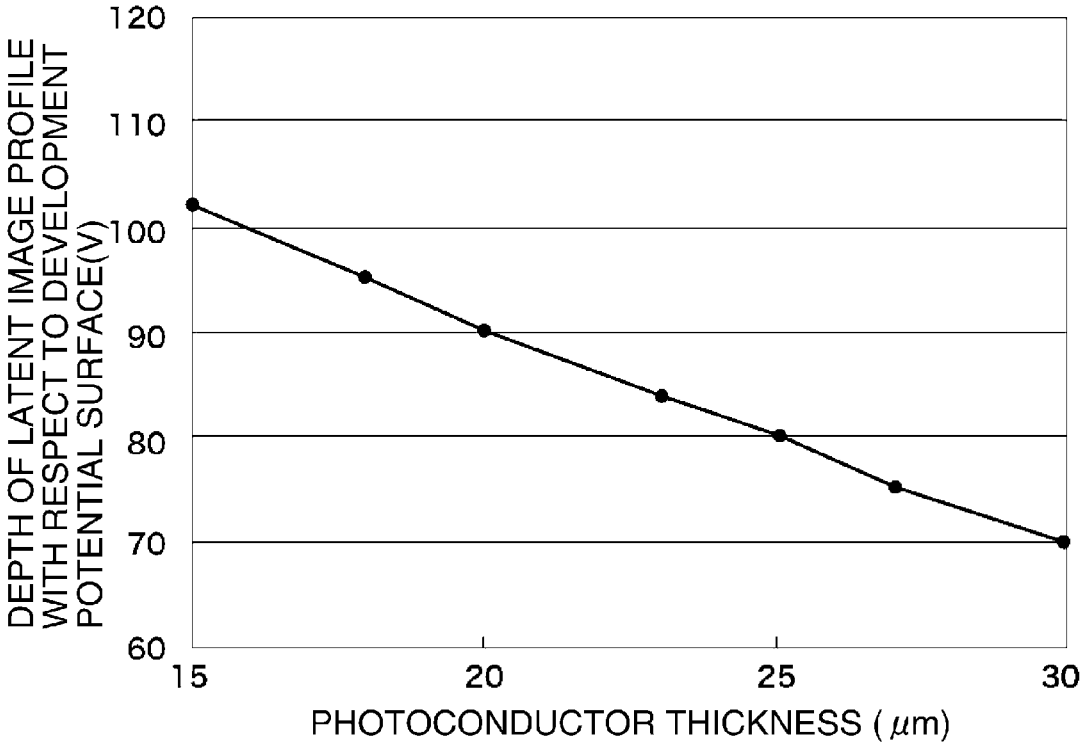
FIG. 11B is a graph showing relation between the photoconductor thickness and depth of the latent image profile with respect to the development potential surface.

FIG. 11A is a graph showing relation between the photoconductor thickness and an inclination of the latent image profile on the development potential surface, which has been found based on the latent image profiles in FIG. 10. FIG. 11B is a graph showing relation between the photoconductor thickness and depth of the latent image profile with respect to the development potential surface.

When the photoconductor thickness decreases, the inclination of the latent image profile on the development potential surface becomes large and the depth of the latent image with respect to the development potential surface increases. This is because the decrease of the photoconductor thickness increases the electric field intensity in the photoconductor and decreases the diffusion length of the carrier and the decrease of a moving distance of a carrier leading up to the surface of the photoconductor decreases the diffusion length.

When the depth of the latent image profile with respect to the development potential surface becomes deep, the charge quantity for burying it increases in the direction of the height of toner image. When the inclination of the latent image profile on the development potential surface increases, the electric field intensity that draws the toner to the photoconductor in the edge of the toner image on the photoconductor becomes strong. As a result, the scattering of the toner at the time of development decreases, and the height of toner image becomes high because the latent image is faithfully developed by the toner.

Thus, when the photoconductor thickness decreases, the latent image profile gets sharp and the height of the toner image on the photoconductor becomes high. In this way, the toner image is easily disordered by electrostatic and dynamic disorders in the transfer process and the fixing process. This is because electrostatic constraining force from the photoconductor to the toner stacked on an upper portion of the toner layer is weak, such a toner is easily scattered from the center of the latent image profile and varies the area of one dot, and such a toner becomes unstable dynamically. This disorder of the toner image deteriorates the graininess.

The inventors investigated the relation between the height of toner image and the ease of disorder of the dot first, in order to investigate the effect of the height of toner image on the photoconductor on the graininess. Specifically, standard deviation of the dot area that constituted a halftone of an outputted image was considered to be a value that expressed the disorder of one dot, and the photoconductors of which the thicknesses were changed from 30 μm to 15 μm were prepared. An image was formed using the photoconductors, and the standard deviation of the dot area was measured.

Figure 12A:
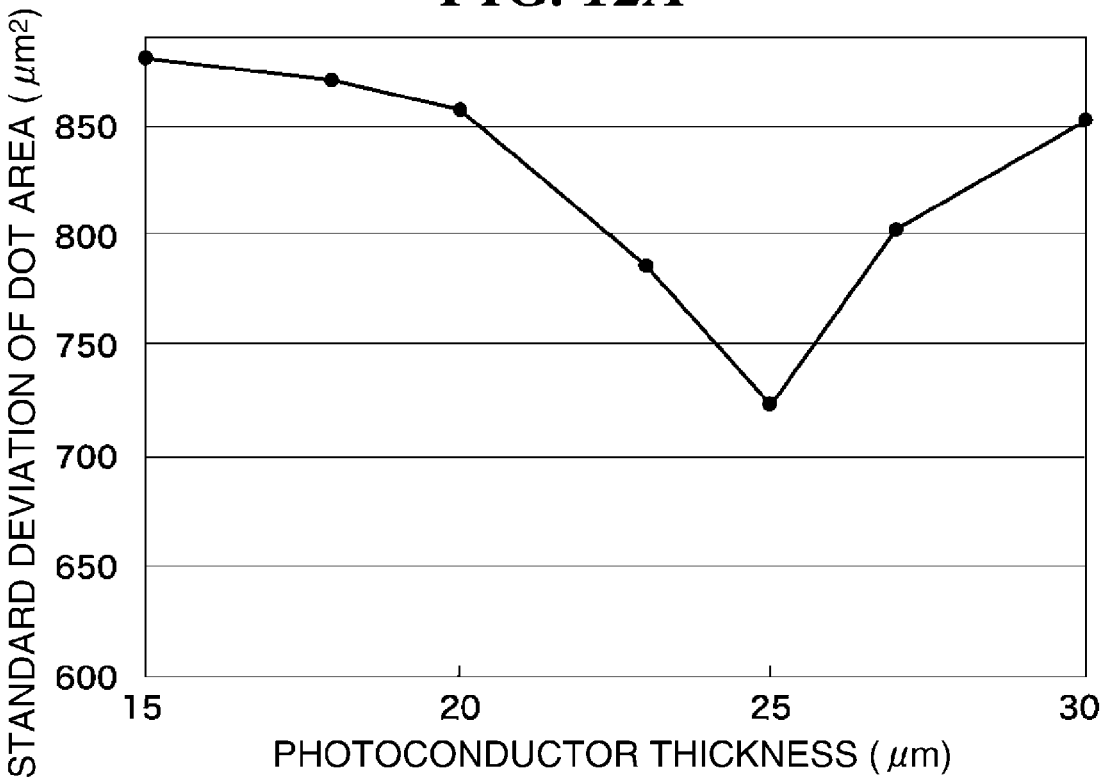
FIG. 12A is a graph showing relation between the photoconductor thickness and a standard deviation of a dot area.
Figure 12B:
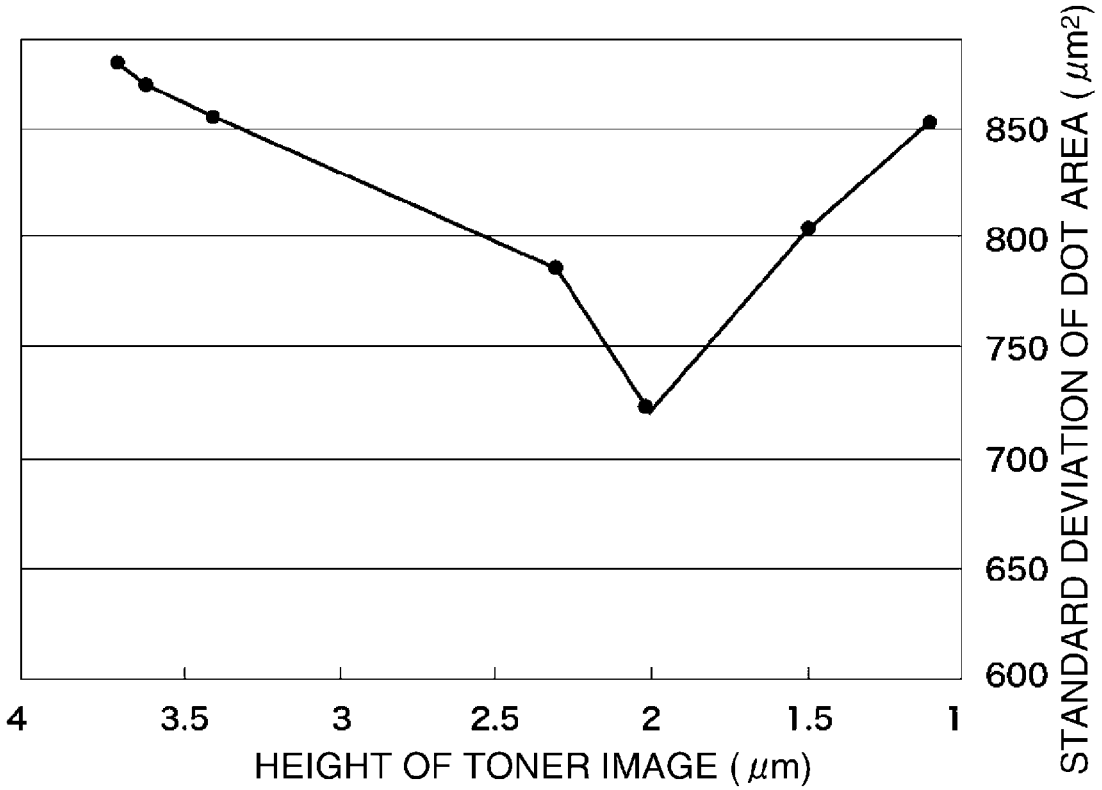
FIG. 12B is a graph showing relation between the height of toner image corresponding to the photoconductor thickness and the standard deviation of the dot area.

FIG. 12A is a graph showing relation between the photoconductor thickness and the standard deviation of the dot area. FIG. 12B is a graph showing relation between the height of toner image corresponding to the photoconductor thickness and the standard deviation of the dot area.

The larger the standard deviation of the dot areas is, the larger the area of one dot is. Therefore, as shown in FIG. 12A, when the case of the photoconductor thickness of 25 μm is compared with the case of the photoconductor thickness of 15 μm, the area of one dot increases with decreasing photoconductor thickness. FIG. 12B shows that the area of one dot increases as the height of toner image increases from 2 μm to 3.8 μm (it corresponds to the decrease of the photoconductor thickness from 25 μm to 15 μm). This is because the decrease of the photoconductor thickness from 25 μm to 15 μm increases the height of toner image and the toner image is easily disordered in the transfer process and the fixing process.

Figure 13:
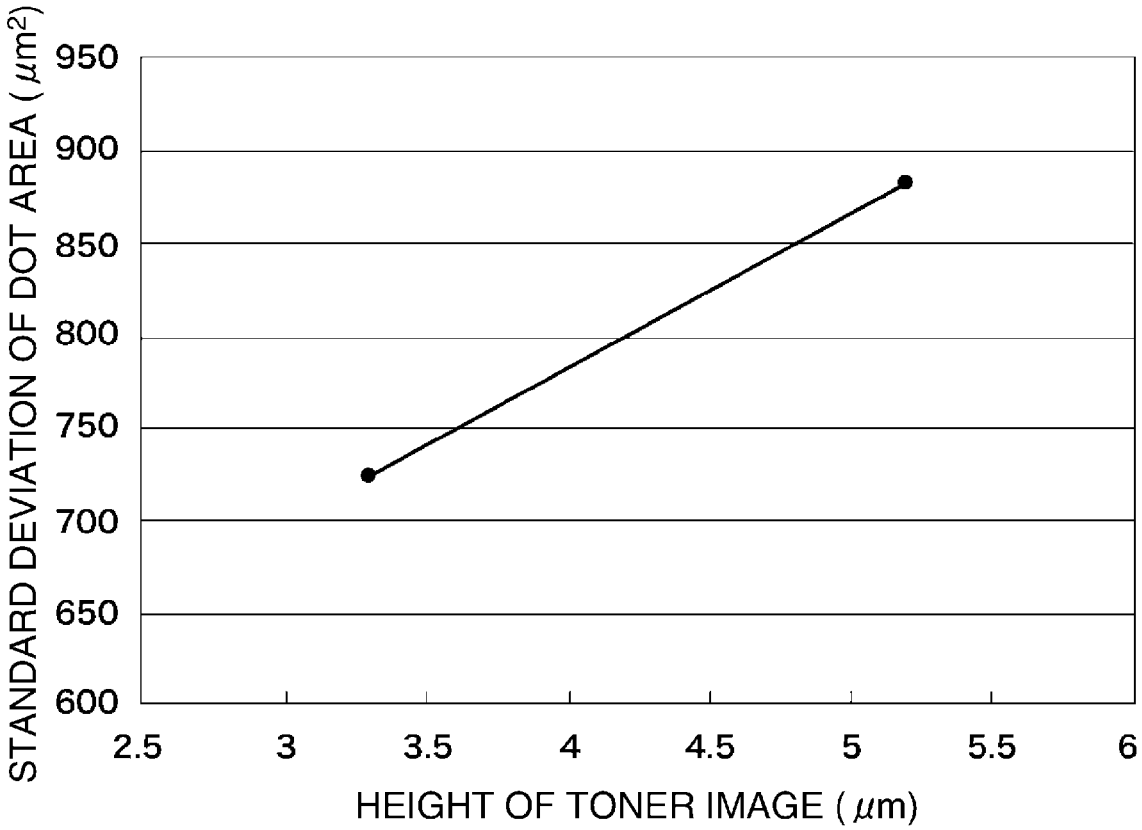
FIG. 13 is a graph showing relation between the height of toner image and the standard deviation of the dot area in an outputted image that increases only the height of toner image to the result where the photoconductor thickness is 25 μm.

FIG. 13 is a graph showing relation between the height of toner image and the standard deviation of the dot areas in an outputted image that increases only the height of toner image by raising the development contrast by about 7% to the result where the photoconductor thickness is 25 μm. This aims to remove the effect on the graininess by factors, such as variation of developing characteristic of the toner owing to the variation of the photoconductor thickness, other than the height of toner image.

As shown in FIG. 13, when the height of toner image becomes high, the standard deviation of the dot areas increases, i.e., the area of one dot increases. Thus, when the photoconductor thickness decreases, the latent image profile gets sharp and the height of toner image on the photoconductor becomes high, and the graininess of the outputted image deteriorates because the area of the toner image in the transfer process and the fixing process rises dynamically and electrostatically. Therefore, it is necessary to optimize the height of toner image in order to keep the graininess constant even if the photoconductor thickness decreases.

In this embodiment, the optimization of the height of toner image is controlled by adjusting the exposure spot diameter that is a spot diameter to expose one dot. Therefore, first, in order to understand the relation between the exposure spot diameter and the height of toner image, the effect of the exposure spot diameter on the latent image profile will be described.

Figure 14:
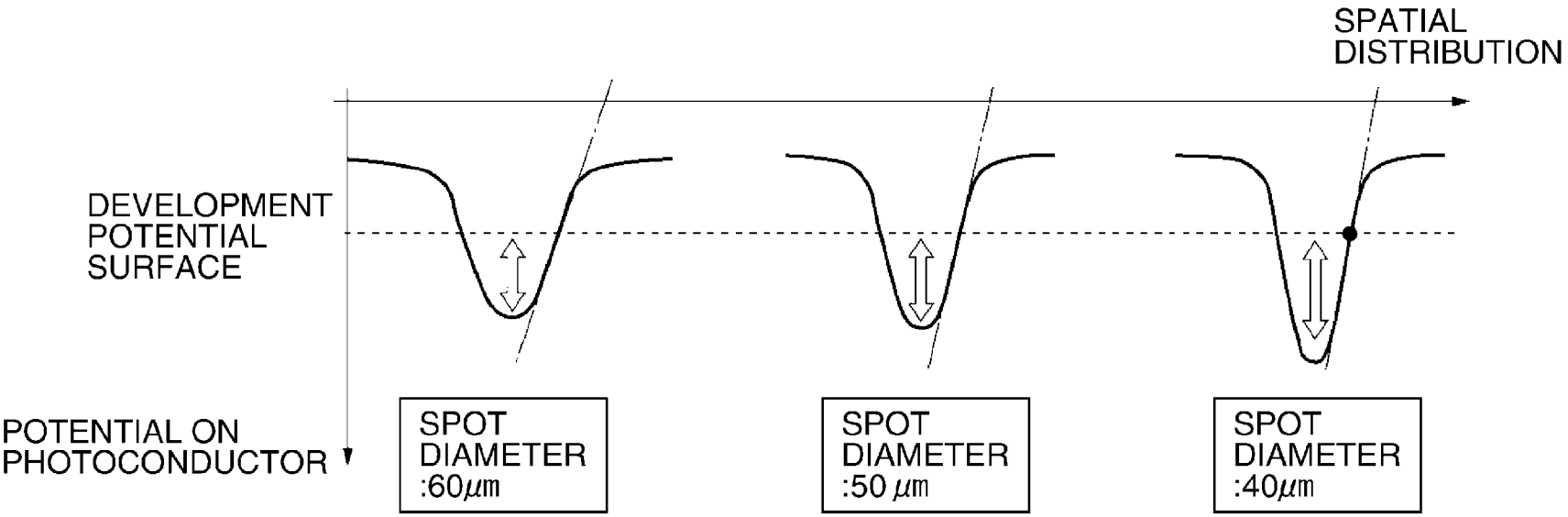
FIG. 14 is a view showing variation of the latent image profile depending on variation of the exposure spot diameter.

In order to investigate this effect, a simulation result about the latent image profile will be described. FIG. 14 is a view showing variation of the latent image profile depending on variation of the exposure spot diameter. In FIG. 14, the vertical axis denotes the electric potential of the latent image like in FIG. 10, and the latent image profiles whose exposure spot diameters are 60 μm, 50 μm, and 40 μm are illustrated sequentially from the left side. The latent image simulation assumes that the photoconductor thickness is 25 μm and the exposing condition is adjusted so that the development contrast potentials of the solid black areas for the respective photoconductor thicknesses agree to one another. It should be noted that the development contrast potential is given as a difference between the electric potential of the latent image of the solid black area and the development electric potential.

Figure 15A:
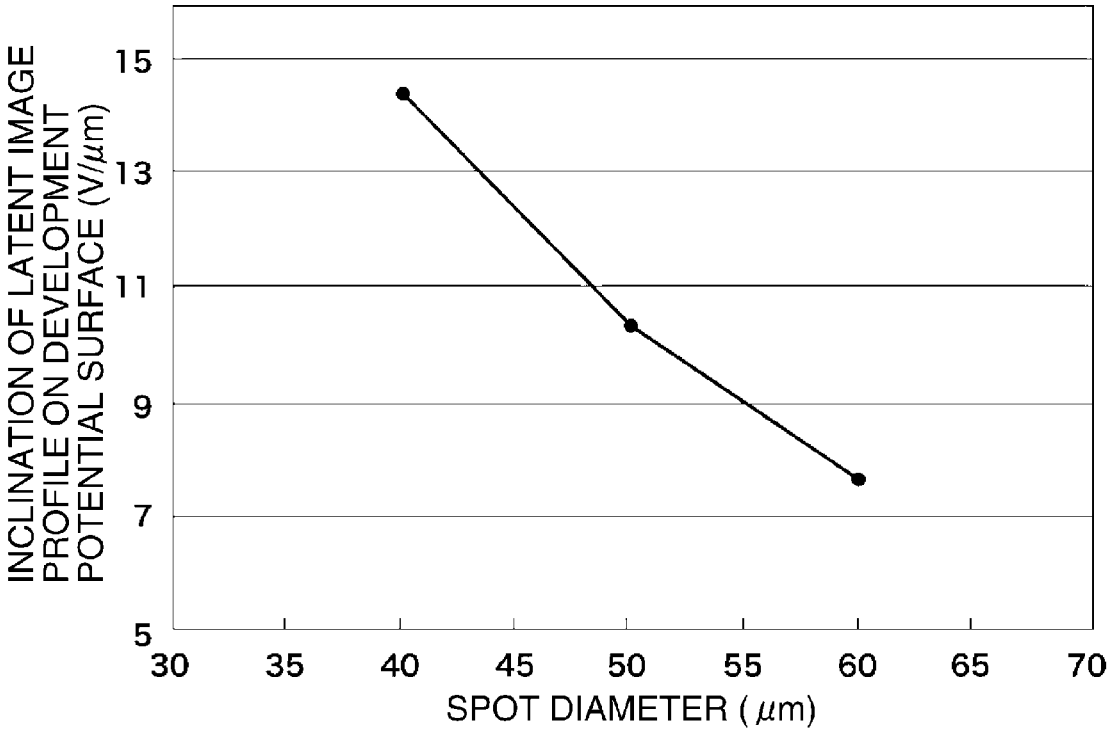
FIG. 15A is a graph showing relation between the exposure spot diameter and the inclination of the latent image profile on the development potential surface.
Figure 15B:
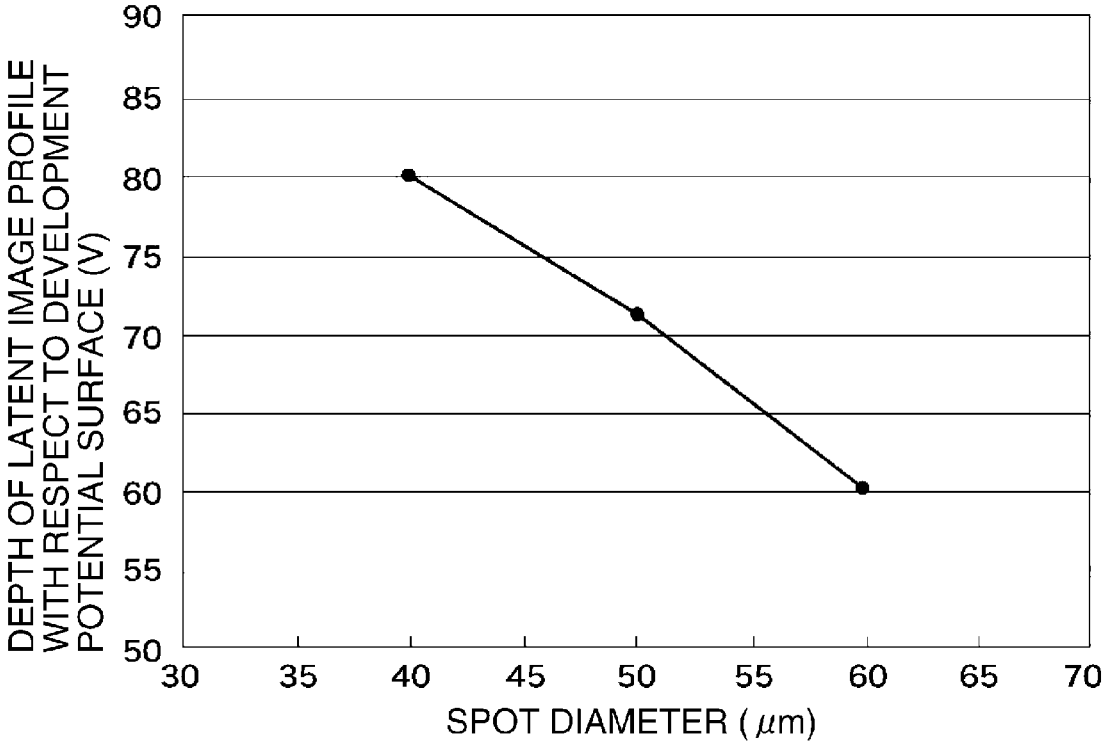
FIG. 15B is a graph showing relation between the exposure spot diameter and depth of the latent image profile with respect to the development potential surface.

FIG. 15A is a graph showing relation between the exposure spot diameter and an inclination of the latent image profile on the development potential surface, which has been found based on the latent image profiles in FIG. 14. FIG. 15B is a graph showing relation between the exposure spot diameter and depth of the latent image profile with respect to the development potential surface. As shown in FIG. 15A and FIG. 15B, when the exposure spot diameter decreases, the inclination of the latent image profile on the development potential surface becomes larger and the depth of the latent image with respect to the development potential surface becomes deeper.

This is because the decrease of the exposure spot diameter increases the inclination of the exposure profile in certain exposure intensity and increases the peak light amount. That is, since the number of excitation carriers that are generated in the charge generation layer of the photoconductor is dependent on the exposure intensity, the inclination of the exposure profile and the peak light amount are reflected to inclination of distribution and the peak value of the excitation carriers that are generated in the charge generation layer. In this way, the inclination and the peak value of the exposure profile are reflected to the inclination and the depth of the latent image profile.

That is, since the decrease of the exposure spot diameter increases the inclination of the exposure profile at the certain exposure intensity and increases the peak light amount, the inclination of the latent image profile on the development potential surface becomes large, and the depth of the latent image profile with respect to the development potential surface becomes deep. When the depth of the latent image profile with respect to the development potential surface becomes deep, the charge quantity for burying it increases in the direction of the height of toner image. When the inclination of the latent image profile on the development potential surface increases, the scattering of the toner in the edge of the toner image on the photoconductor decreases and the latent image is faithfully developed by the toner. Accordingly, the height of toner image becomes high.

Figure 16:
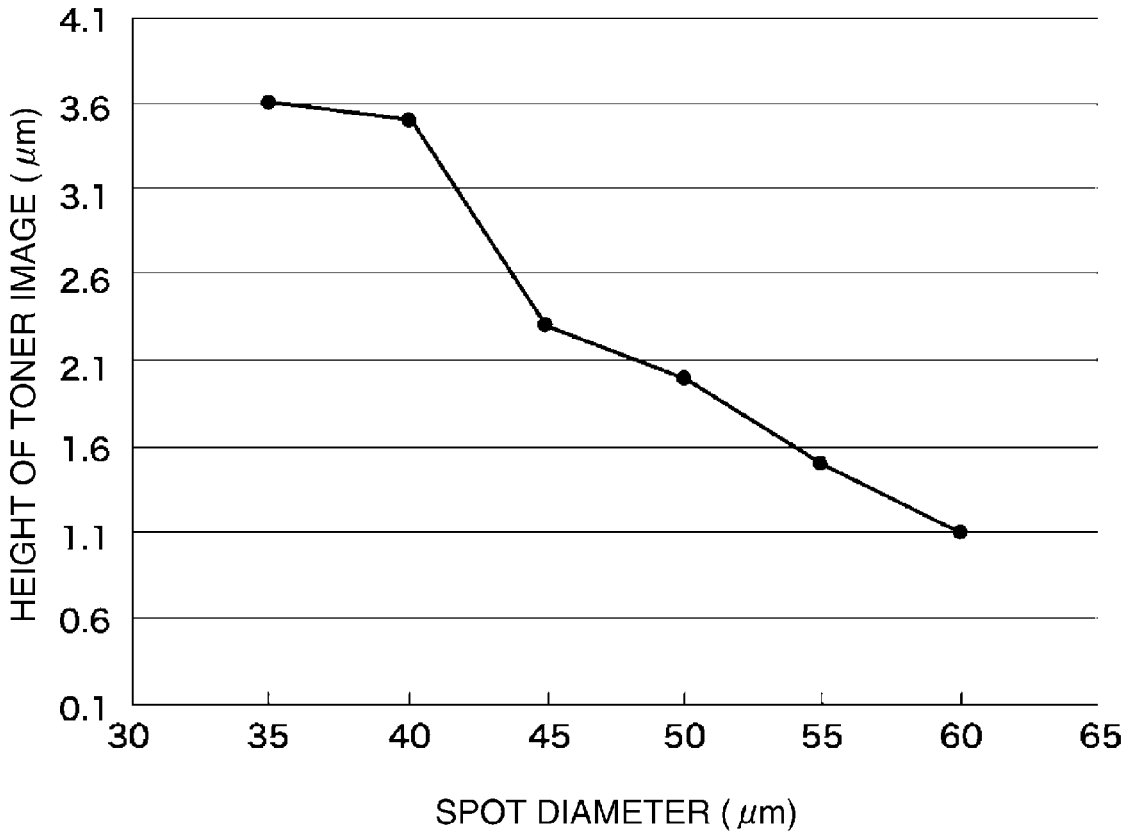
FIG. 16 is a graph showing relation between the exposure spot diameter and the height of toner image on the photoconductor when changing only the exposure spot diameter.

FIG. 16 is a graph showing a result of actual measurement of the height of toner image on the photoconductor under the same photoconductor thickness and the same development condition while changing the exposure spot diameter only. As shown in FIG. 16, the height of toner image becomes higher as the exposure spot diameter becomes smaller. This shows that the height of toner image is controllable by changing the exposure spot diameter.

Next, the effect of an environmental condition on the graininess will be described. For example, when the image forming apparatus is located in atmosphere (i.e., environment) of low-humidity and low-temperature, since the resistance of the transfer member, such as the primary transfer roller, increases, primary transfer bias is set highly in order to optimize transfer efficiency. However, when the primary transfer bias is set highly, the electric field spreads to a nip upstream part, and since the toner easily scatters (discharges) in front of a transfer nip, the height of toner image has large effect on the graininess.

Figure 17A:
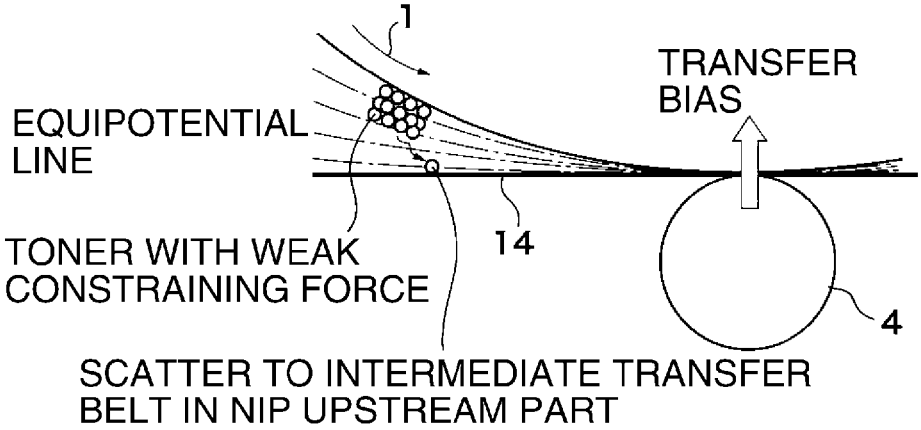
FIG. 17A is a schematic view showing a mechanism of scattering toner.
Figure 17B:
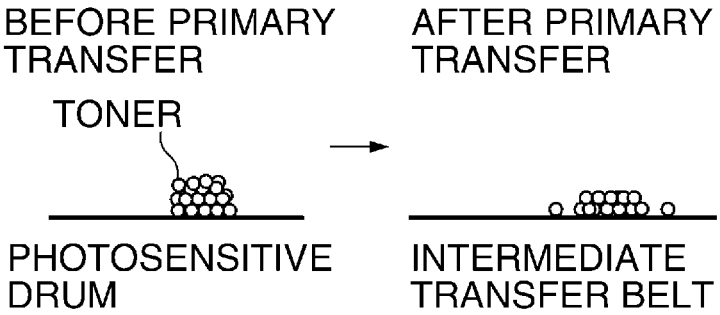
FIG. 17B is a schematic view showing the toner image before and after transfer when the toner scattered.
Figure 17C:
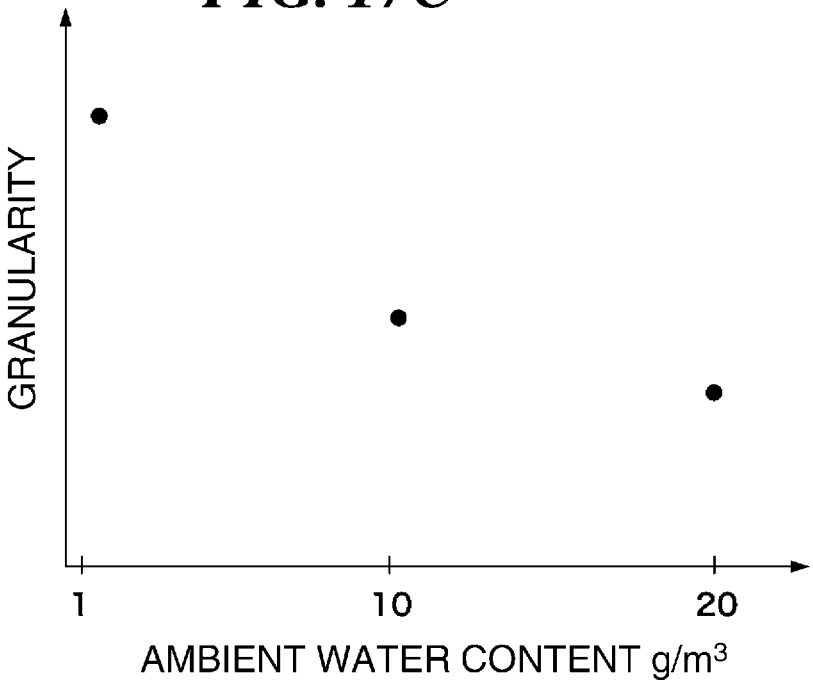
FIG. 17C is a plot showing relation between ambient water content and the graininess when keeping the height of toner image constant.

FIG. 17A is a schematic view showing a mechanism of scattering toner. FIG. 17B is a schematic view showing the toner image before and after transfer when the toner scattered. FIG. 17C is a plot showing relation between ambient water content and the graininess when keeping the height of toner image constant. It should be noted that the graph in FIG. 17C is obtained under a condition where the outputted image densities in the respective atmospheres are identical.

As shown in FIG. 17A, the higher the electric field of the nip upstream part is, the easier the scattering of the toner in the upper portion of the toner layer (i.e., the toner of the weak constraining force to the photoconductor) onto the intermediate transfer belt is. Accordingly, as shown in FIG. 17B, the toner image (after primary transfer) on the intermediate transfer belt is disordered as compared with the toner image (before primary transfer) on the photoconductor. As shown in FIG. 17C, the graininess has deteriorated under the condition of the low ambient water content and the high transfer bias, as compared with the condition of the high ambient water content and the low transfer bias.

When the effect of the exposure spot diameter and the ambient environment on the graininess is taken into consideration, the decrease of the exposure spot diameter improves the sharpness and the development reproducibility of the latent image profile and improves resistance to variations in the latent image formation and the developing process, which improves the graininess. However, the height of the toner layer (i.e., the height of toner image) becomes high at the same time. When the height of toner image becomes high, since the constraining force from the photoconductor to the toner stacked on the upper portion is weak, such a toner is easily scattered, which deteriorates the graininess at the transfer section. In the installed environment of low-humidity and low-temperature, since the high resistance of the transfer section needs the high transfer bias, the electric field spreads in the nip upstream part strongly, which eases the scattering of the toner and deteriorates the graininess.

Figure 18:
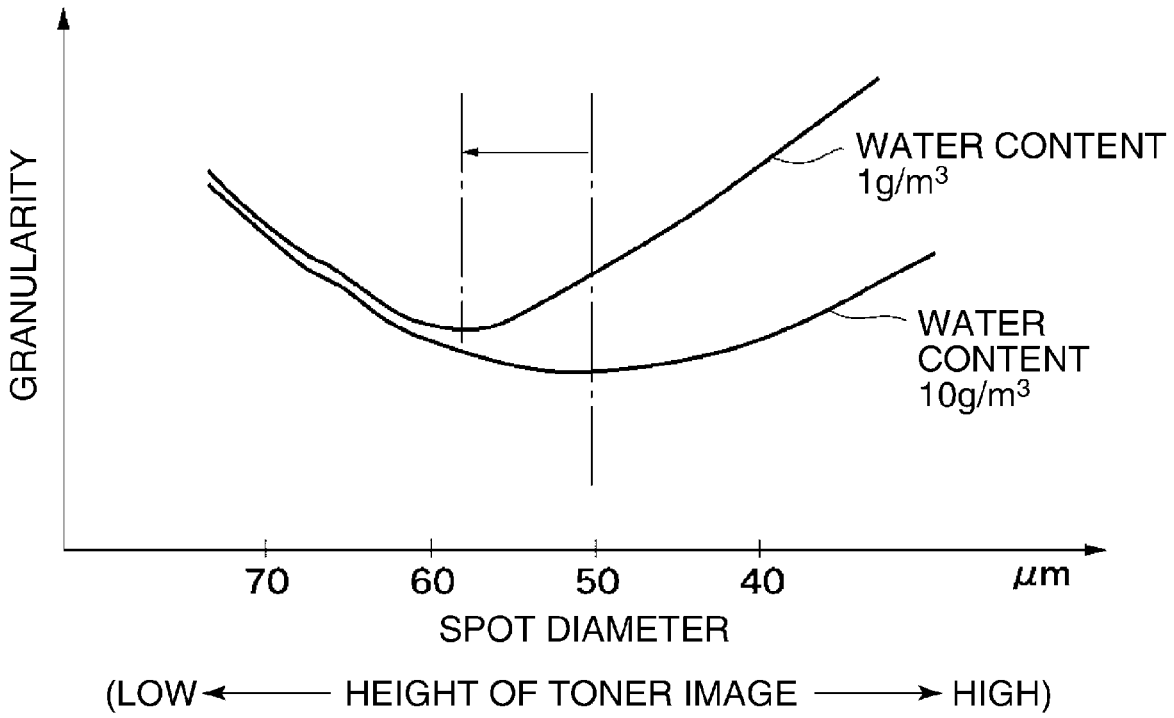
FIG. 18 is a graph showing measurement result of the graininess while changing the exposure spot diameter under environments of different ambient water contents.

From the above description, it is shown that the graininess is improved by setting the exposure spot diameter that forms the optimal height of toner image in consideration of the ambient environment. FIG. 18 is a graph showing a result of investigation of the graininess in the environments of different ambient water contents while changing the exposure spot diameter by changing a focal point. A vertical axis in FIG. 18 denotes the graininess and a horizontal axis denotes the exposure spot diameter. The graph in FIG. 18 is obtained under a condition where the outputted image densities in the respective conditions are identical.

As shown in FIG. 18, the smaller the exposure spot diameter is, the higher the height of toner image is. When the exposure spot diameter decreases from 70 μm to 60 μm or 50 μm, the graininess improves according to effect of stabilization of development. However, when the exposure spot diameter becomes still smaller and the height of toner image becomes higher, the effect of the height of toner image becomes strong and the graininess deteriorates from a certain point. In FIG. 18, the points from which the graininess deteriorates are shown by alternate long and short dash lines. It is shown that the point from which the graininess deteriorates is located at lower value of the height of toner image as the water content of the ambient environment decreases.

As mentioned above, the height of toner image is required to be the optimal value in consideration of the conditions at the time of image formation in order to keep good graininess even if the factors (variation of the height of toner image owing to the reduction in the photoconductor thickness, or variation of the effect of the height of toner image on the graininess according to the change of the environmental condition) that affect the graininess vary. Accordingly, in this embodiment, first, the test patterns shown in FIG. 7 are outputted while changing the exposure spot diameter for each pattern so to change the height of toner image for each environmental condition and each endurance condition (referred to as an "environmental endurance condition", hereafter), and the graininess is detected for each height of toner image. Based on the detection result, the relation between the graininess and the height of toner image is grasped, and the height of toner image is optimized so that the good graininess is always maintained.

Figure 19:
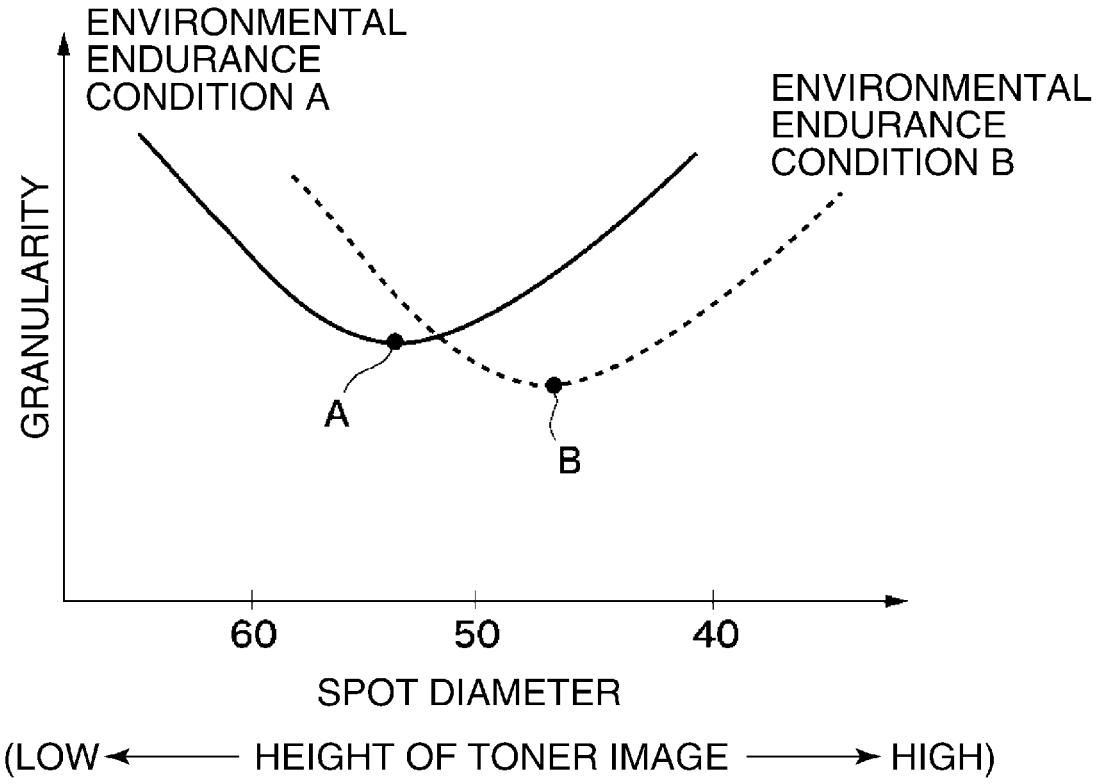
FIG. 19 is a graph schematically showing optimization of the height of toner image with respect to an environmental endurance condition according to this embodiment.

FIG. 19 is a graph schematically showing optimization of the height of toner image with respect to the environmental endurance condition according to this embodiment. In FIG. 19, a vertical axis denotes the granularity (graininess), and a horizontal axis denotes the exposure spot diameter (the height of toner image). It should be noted that the change of the exposure spot diameter corresponds to the change of the height of toner image as mentioned above.

As shown in FIG. 19, the optimal exposure spot diameter (the height of toner image) for the conditions at the time of image formation is grasped by measuring the granularity of the outputted image for every exposure spot diameter while changing the exposure spot diameter. For example, in FIG.

19, it is assumed that a solid line graph expresses data under an initial environmental endurance condition (environmental endurance condition A) and a dotted line graph expresses data under an later environmental endurance condition B that is changed from the environmental endurance condition A with change of the environmental condition or deterioration of the endurance condition. At this time, the image formation should be performed with the exposure spot diameter (the height of toner image) that is denoted by a point A under the environmental endurance condition A, and the image formation should be performed with the exposure spot diameter (the height of toner image) that is denoted by a point B under the environmental endurance condition B.

Figure 20:
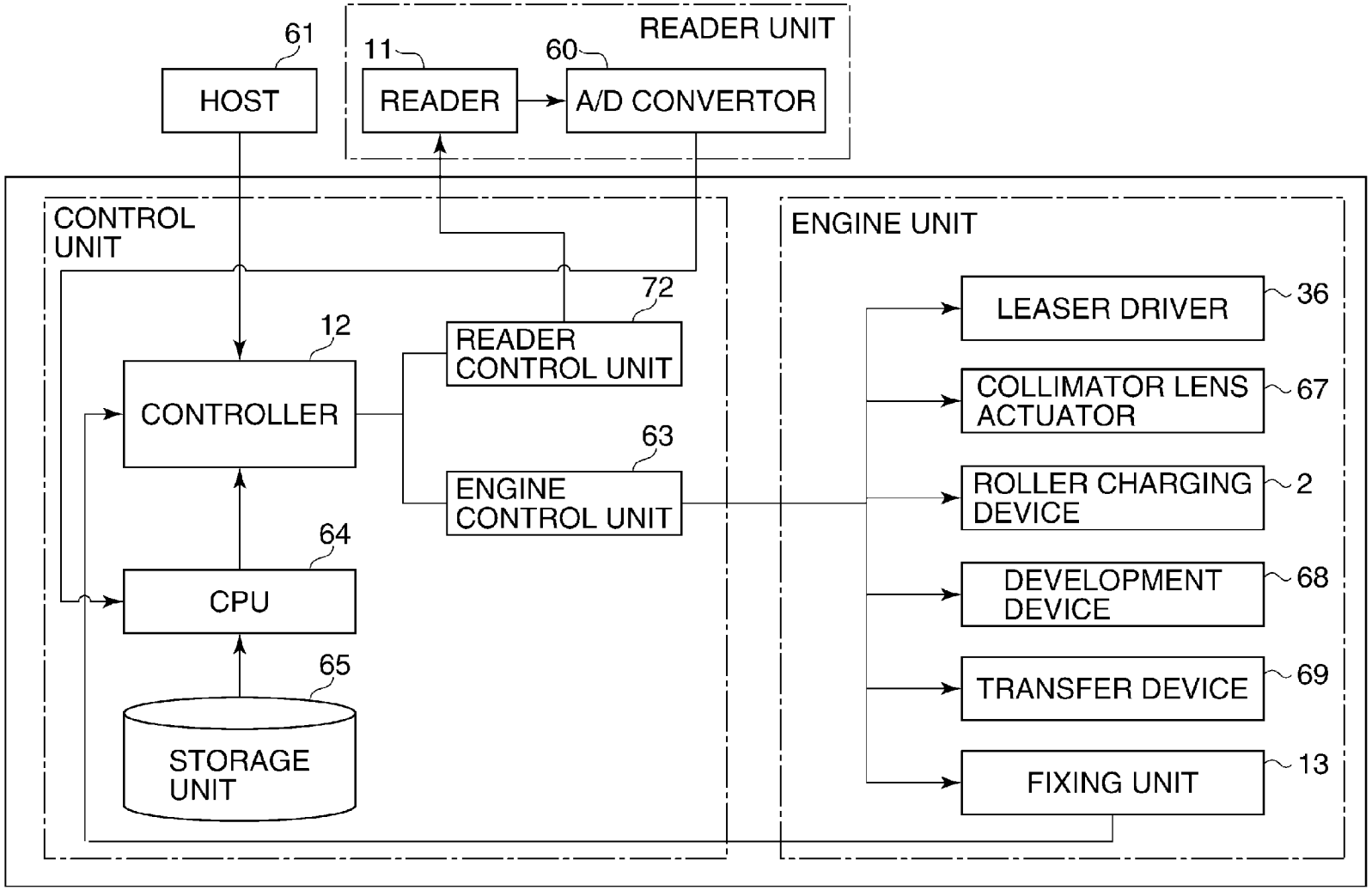
FIG. 20 is a block diagram schematically showing a configuration of the image forming apparatus including a control system according to a first embodiment.

FIG. 20 is a block diagram schematically showing a configuration of the image forming apparatus including a control system according to the first embodiment. As shown in FIG. 20, the image forming apparatus comprises a host 61, a reader unit, a control unit, and an engine unit in summary. The host 61 inputs an image signal. The reader unit reads image information about an original. The control unit controls image formation. The engine unit has various kinds of driving devices in the image forming apparatus.

The control unit has the controller 12 that controls the whole image forming apparatus, a reader control unit 72 that controls the reader unit, an engine control unit 63 that controls an engine unit, and a central processing unit (CPU) 64 that performs a calculation process based on input information. The control unit has a storage unit 65 that stores the relation between the graininess and the height of toner image (exposure spot diameter), the exposure spot diameter, the relation between the exposure spot diameter and the movement of the collimator lens, an image formation sheet number, types of input signals to the host, etc.

It should be noted that a collimator lens actuator 67 with which the engine unit is provided includes a drive system of the collimator lens 33 and the collimator lens 33. A development device 68 includes the exposure device 7 and the two-component development device 3. A transfer device 69 includes the primary transfer roller 4, the intermediate transfer belt 8, the secondary transfer roller 9, and drive systems thereof. Since the laser driver 36, the roller charging device 2, the fixing unit 13, the reader 11, and the A/D convertor 60 have been described above, their descriptions are omitted here.

Figure 21A:
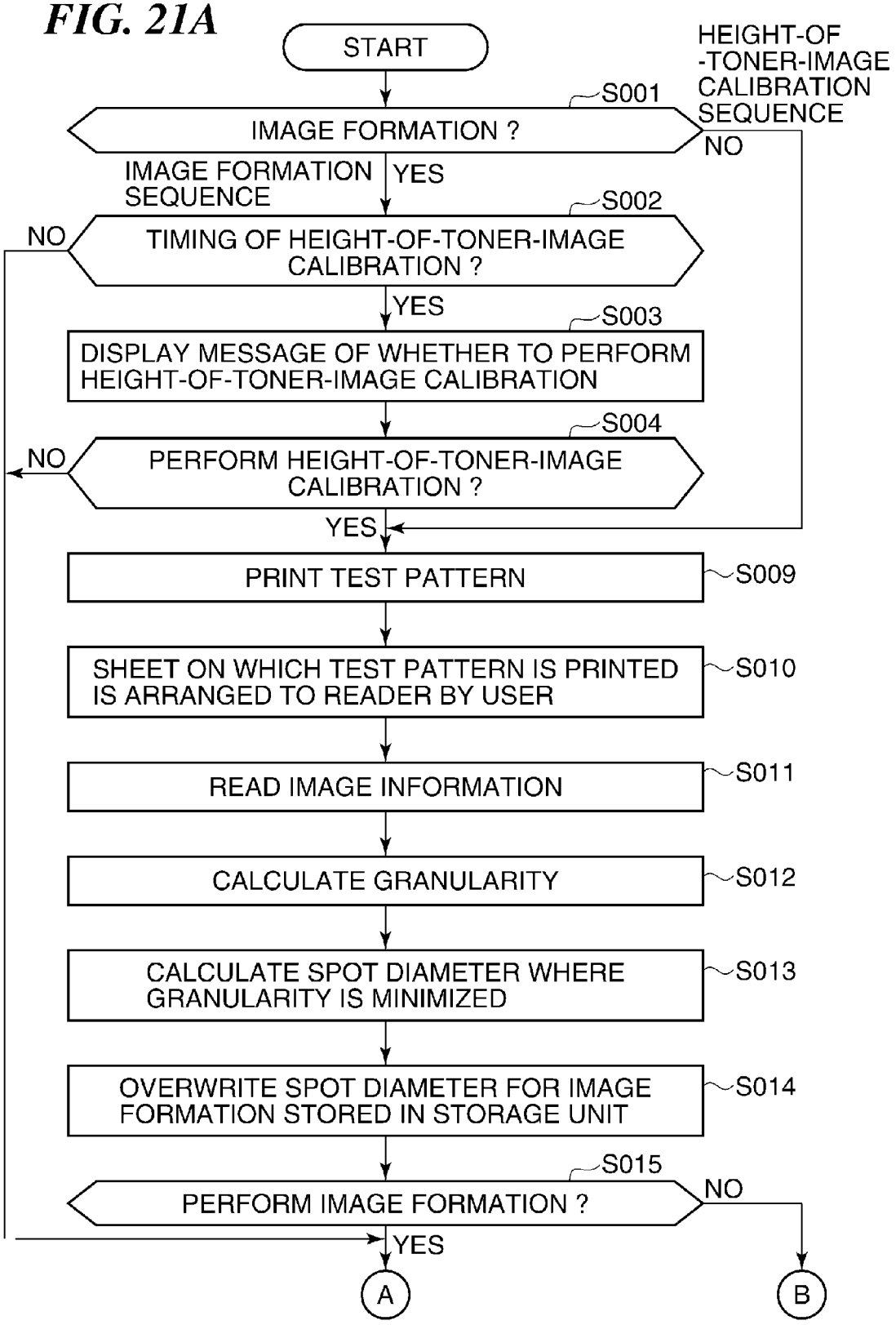
FIG. 21A and FIG. 21B are flowcharts showing an image forming process according to the first embodiment executed by the image forming apparatus in FIG. 20.
Figure 21B:
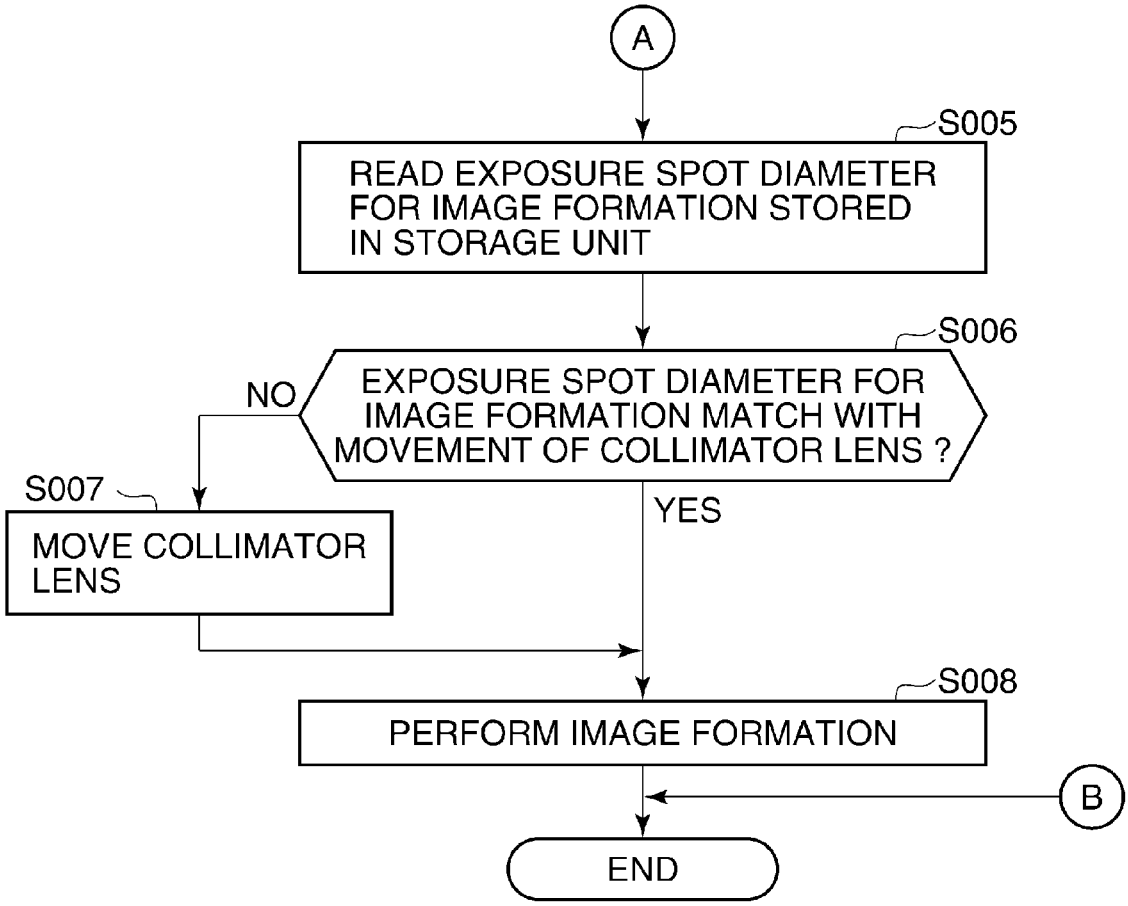

FIG. 21A and FIG. 21B are flowcharts showing an image forming process according to the first embodiment executed by the image forming apparatus in FIG. 20. The image forming process in FIG. 21A and FIG. 21B is achieved when the CPU 64 performs required operations and generates control signals based on input information, the controller 12 controls various control units based on the control signals, and various kinds of mechanisms that constitute the image forming apparatus exhibit predetermined functions.

When a user operates the image forming apparatus to input a print signal or a height-of-toner-image calibration start signal to the host 61, the controller 12 determines whether the input signal is a print signal (step S001). When the input signal is a print signal (YES in the step S001), the controller 12 proceeds with the process to an image formation sequence. When the input signal is not a print signal (NO in the step S001, i.e., when it is a height-of-toner-image calibration start signal), the controller 12 proceeds with the process to the height-of-toner-image calibration sequence.

The image formation sequence will be described. In the image formation sequence, the controller 12 determines whether it is timing to perform the height-of-toner-image calibration (step S002). In the step S002, the controller 12 determines to be YES when the image formation sheet number stored in the storage unit 65 reaches 5000 sheets from the time of the last height-of-toner-image calibration, for example. Alternatively, the controller 12 may determine to be YES in the step S002 when a first page is printed after the temperature of the fixing unit 13 drops under 100 degree Celsius based on temperature information about the fixing unit 13.

When performing the height-of-toner-image calibration (YES in the step S002), the controller 12 outputs a message (signal) to urge performing the height-of-toner-image calibration to the host 61. The host 61 displays a message of whether to perform the height-of-toner-image calibration onto a display unit (not shown) of the image forming apparatus (step S003).

The user determines whether to perform the height-of-toner-image calibration based on the message displayed on the display unit (step S004), and inputs the determination result from the display unit or an operation key (not shown) of the image forming apparatus. When performing the height-of-toner-image calibration (YES in the step S004), the controller 12 proceeds with the process to the height-of-toner-image calibration sequence. When not performing the height-of-toner-image calibration (NO in the step S004), the controller 12 read the value of the exposure spot diameter for image formation stored in the storage unit 65 (step S005). Also when not performing the height-of-toner-image calibration (NO in the step S002), the value of the exposure spot diameter for image formation stored in the storage unit 65 is read (step S005).

Subsequently, the controller 12 determines whether the read value of the exposure spot diameter for image formation matches with the value of the movement of the collimator lens 33 recorded in the storage unit 65 (step S006). The determination in this step S006 is performed by referring to a translation table, which defines relation between the exposure spot diameter and the collimator lens movement, stored in the storage unit 65.

When the exposure spot diameter for image formation matches with the collimator lens movement (YES in the step S006), the image formation is performed (step S008). On the other hand, when the exposure spot diameter for image formation does not match with the collimator lens movement (NO in the step S006), the CPU 64 calculates a collimator lens movement based on the translation table (the exposure spot diameter vs. the collimator lens movement) stored in the storage unit 65. The calculated collimator lens movement is converted into a control signal by the controller 12. The control signal is sent to the collimator lens actuator 67 via the engine control unit 63, and the exposure spot diameter for image formation is changed because the collimator lens 33 moves (step S007). In this way, the image formation is performed with the changed exposure spot diameter for image formation (step S008). Then, the process is finished.

Next, the height-of-toner-image calibration sequence will be described. In the height-of-toner-image calibration sequence, test patterns are outputted (printed) first (step S009). These test patterns are the same as the test patterns shown in FIG. 7, and the patterns are printed in the imaging area while changing the exposure spot diameter.

Next, the user arranges the sheet (test image) on which the test patterns are printed to the reader 11 (step S010), and makes the CCD sensor S of the reader 11 read the image information about the test image (step S011). The read image information is converted into the density information for one pixel of every 600 dpi by the CPU 64, and also is converted into the RMS granularity by the CPU 64 (step S012).

Subsequently, the CPU 64 calculates relevant information about relation between the graininess and the height of toner image (exposure spot diameter) based on the RMS granularity of the test pattern for each exposure spot diameter, and calculates the exposure spot diameter where the RMS granularity becomes good relatively (step S013). The exposure spot diameter where the RMS granularity becomes good relatively is preferably equal to the exposure spot diameter with the minimum RMS granularity. The controller 12 sends the calculated exposure spot diameter to the storage unit 65, and overwrites the value of the exposure spot diameter for image formation (S014).

Then, the controller 12 determines whether the signal first inputted into the host 61 has been a print signal with reference to the storage unit 65 (step S015). When it is a print signal (YES in the step S014), the process proceeds to the step S005. When it is not a print signal, i.e., when it is a height-of-toner-image calibration signal (NO in the step S014), the process is finished.

In order to evaluate the effect of the image forming apparatus according to the first embodiment, the case where the image forming method by the image forming apparatus according to the first embodiment is compared with the case where the exposure spot diameter for image formation is fixed (initial value: 40 μm is maintained). Here, a first examination was performed under a constant condition of a normal environment (temperature of 23 degree Celsius, humidity of 40%). A second examination was performed under a variable condition where the normal environment and a low-temperature/low-moisture environment (temperature of 10 degree Celsius, humidity of 10%) are exchanged periodically.

It should be noted that the normal environment and the low-temperature/low-moisture environment were exchanged at the intervals of printing 5000 sheets. The total of the image formation sheet number (printing sheet number) was 50,000 sheets, and a sheet for a color laser beam printer (an A4 size, basis weight of 81.4 g) was used.

Figure 22A:
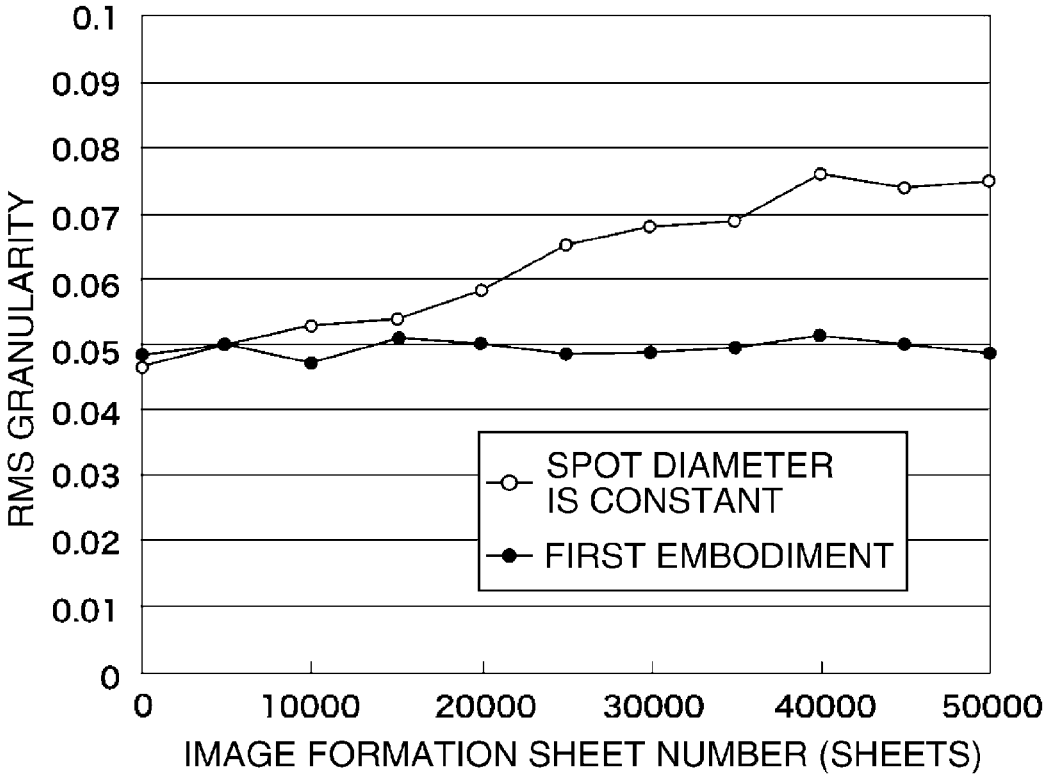
FIG. 22A is a graph showing test results under normal environment about relation between the image formation sheet number and the RMS granularity in the image forming apparatus of the first embodiment.
Figure 22B:
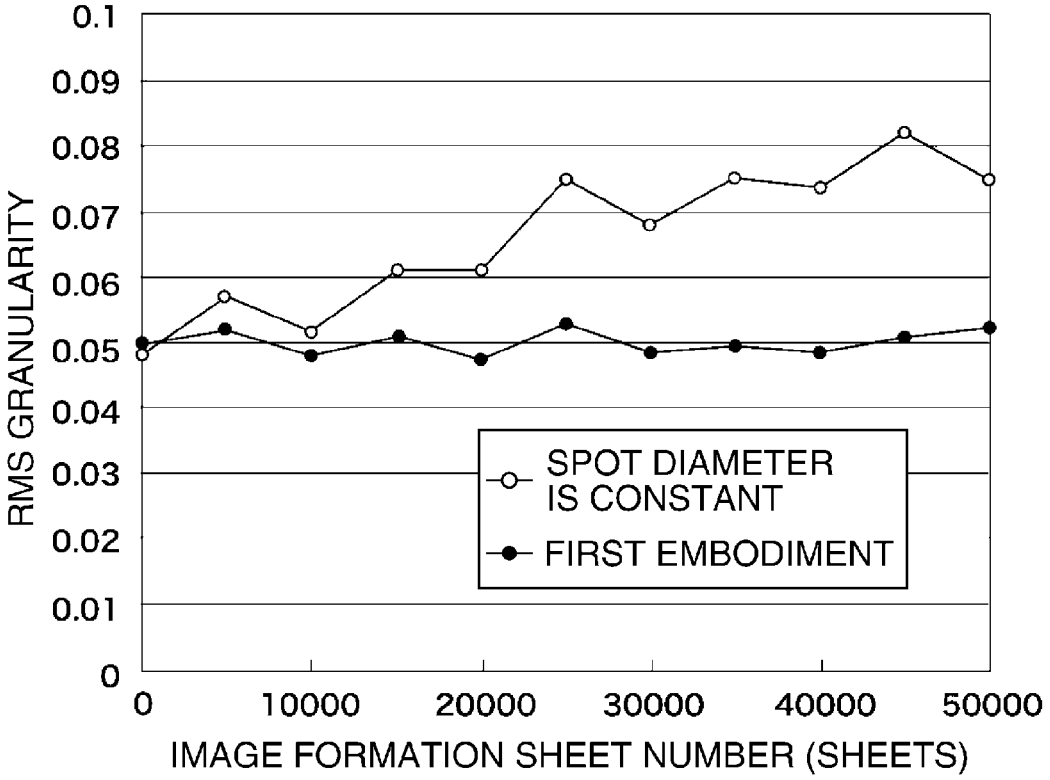
FIG. 22B is a graph showing test results when the normal environment and a low-temperature/low-moisture environment are exchanged periodically, about relation between the image formation sheet number and the RMS granularity in the image forming apparatus of the first embodiment.

FIG. 22A is a graph showing test results under normal environment about relation between the image formation sheet number and the RMS granularity in the image forming apparatus of the first embodiment. FIG. 22B is a graph showing test results when the normal environment and the low-temperature/low-moisture environment are exchanged periodically, about relation between the image formation sheet number and the RMS granularity in the image forming apparatus of the first embodiment.

As shown in FIG. 22A, under the normal environment, when the exposure spot diameter was constant as the conventional case, the RMS granularity increased with increasing image formation sheet number. On the other hand, the image forming apparatus of the first embodiment kept the RMS granularity almost constant even when the image formation sheet number increased. As shown in FIG. 22B, the conventional case of which the exposure spot diameter was constant was greatly affected by the periodic change of the normal environment and the low-temperature/low-moisture environment, and therefore, the RMS granularity increased with increasing image formation sheet number. On the other hand, it was evaluated that the image forming apparatus of the first embodiment kept the RMS granularity at about 0.05, even when the normal environment and the low-temperature/low-moisture environment are exchanged periodically, and when the image formation sheet number increased.

Thus, when the image forming apparatus and image forming method according to the first embodiment are used, the good graininess can be kept even if the environmental condition or the endurance condition varies. That is, the imaging quality is maintainable over a long period of time.

An image forming apparatus according to the second embodiment is different from the image forming apparatus of the first embodiment in the configuration of the exposure device 7 and the changing method for the exposure profile of the exposure spot on the photoconductor 1, and the other members are common to the first embodiment. Therefore, the contents common to the first embodiment will be omitted to describe or described briefly, and the characteristic members of the image forming apparatus of the second embodiment will be described in detail hereafter.

Figure 23A:
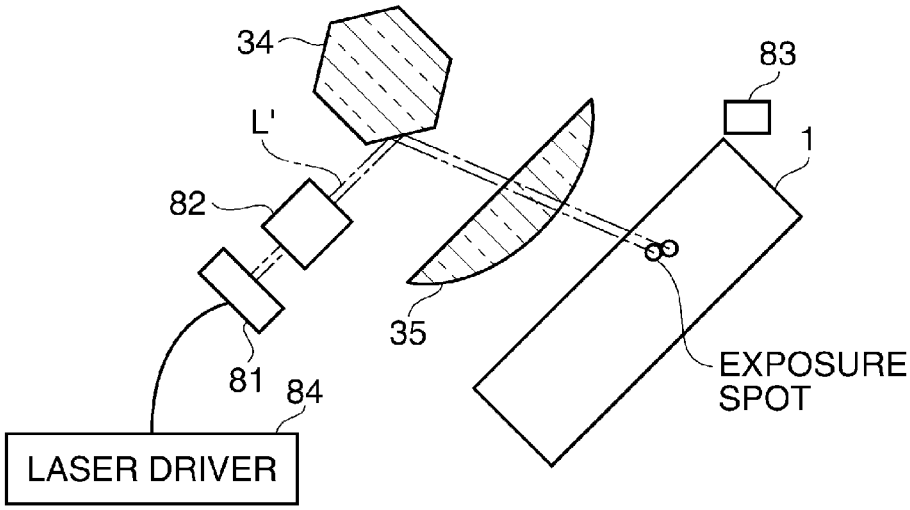
FIG. 23A is a view schematically showing a configuration of an exposure device with which an image forming apparatus according to a second embodiment of the present invention is provided.
Figure 23B:
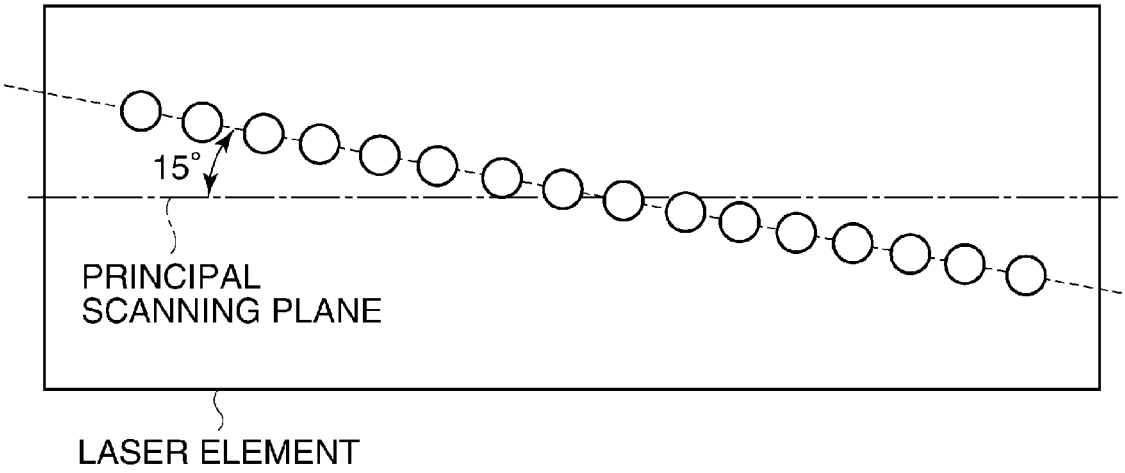
FIG. 23B is a view showing a configuration of an exposure light source in the exposure device shown in FIG. 23A.

FIG. 23A is a view schematically showing a configuration of an exposure device with which an image forming apparatus according to the second embodiment is provided. FIG. 23B is a view showing a configuration of an exposure light source in the exposure device shown in FIG. 23A. As shown in FIG. 23B, the exposure light source 81 is a surface emission-type laser that has 16 pieces of laser light sources, and the laser light sources are linearly arranged so that the alignment line crosses a principal scanning plane at an angle of 15 degrees. The light amount distribution of the exposure spot on the photoconductor 1 of each laser beam is Gaussian, and every laser beam forms the same distribution. Resolution of the exposure spot formed on the photoconductor 1 is 1200 dpi in both of a principal scanning direction and an auxiliary scanning direction of the laser beam. An exposure spot diameter on the photoconductor 1 of each laser beam is 40 μm.

The laser beam L' emitted from the exposure light source 81 is converted into a parallel beam through a collimator lens 82, is reflected by a rotating polygonal mirror 34 that has six mirror surfaces around it, and is scanned. The laser beam L' reflected by the rotating polygonal mirror 34 is converged by an f-θlens 35 onto the photoconductor 1. A laser driver 84 that controls light-emitting timing and intensity of the laser beam is connected to the exposure light source 81.

A photodiode 83 that detects scanning timing of the laser beam is installed on a laser scan surface, and detects the scanning timing of the laser beam outside the scan area of the photoconductor 1. The detected signal is sent to the laser driver 84, and the laser driver 84 controls scanning start timing to the photoconductor 1 of each laser light source of the exposure light source 81 based on the detection timing.

Figure 24A:
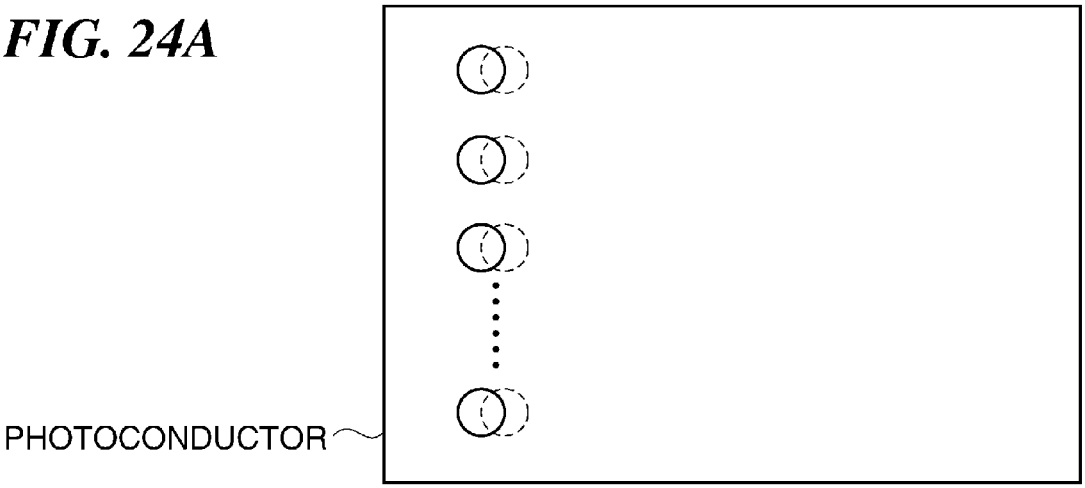
FIG. 24A is a view schematically showing in a scanning state of an exposure laser beam on the photoconductor in the image forming apparatus according to the second embodiment.

According to the second embodiment, an overlap of the exposure spots of two laser beams is used as a factor for keeping the exposure profile on the photoconductor 1. FIG. 24A is a view schematically showing in a scanning state of an exposure laser beam on the photoconductor 1 in the image forming process according to the second embodiment.

The exposure spots on the photoconductor 1 at the time of the scan start formed by the laser beams that are emitted from 16 pieces of the laser light sources as the exposure light sources, and are reflected by the predetermined mirror surface of the rotating polygonal mirror 34 are illustrated by solid line circles in FIG. 24A (4 spots of 16 spot are only illustrated). Here, the reason why the 16 exposure spots are aligned on the photoconductor 1 in the auxiliary scanning direction is that light emission timings of 16 pieces of the laser light sources are shifted in time. In the following description, the scan by the exposure spots shown by the solid line circles will be called a first scan for convenience. The exposure spots on the photoconductor 1 at the time of the scan start formed of the laser beams reflected by the next mirror surface of the rotating polygonal mirror 34 are shown by broken line circles in FIG. 24A. In the following description, the scan by the exposure spot shown by the broken line circles will be called a second scan for convenience.

As shown in FIG. 24A, an exposure profile is formed on the photoconductor 1 by overlapping two exposure spots formed on the photoconductor 1 by the laser beams reflected by different mirror surfaces of the rotating polygon mirror 34 while slightly shifting the centers. This method is performed by slightly shifting the scanning start timing of the second scan with respect to the scanning start timing of the first scan based on the timing detected by the photodiode 83.

Assuming that a gap between the centers of two exposure spots is "Δ", the gap Δ between the centers of the exposure spots can be changed according to the shift between the scan start timings of the first and second scans. According to the second embodiment, the inclination of the latent image on the development potential surface and the depth with respect to the development potential surface are kept constant by changing the gap Δ between the centers of the exposure spots to change the exposure profile.

In order to understand the changing method of the exposure profile to reduction in the photoconductor thickness in the second embodiment, variation of the exposure profile by shifting the centers of the exposure spots and variation of the latent image profile by varying the exposure profile will be described.

Figure 24B:
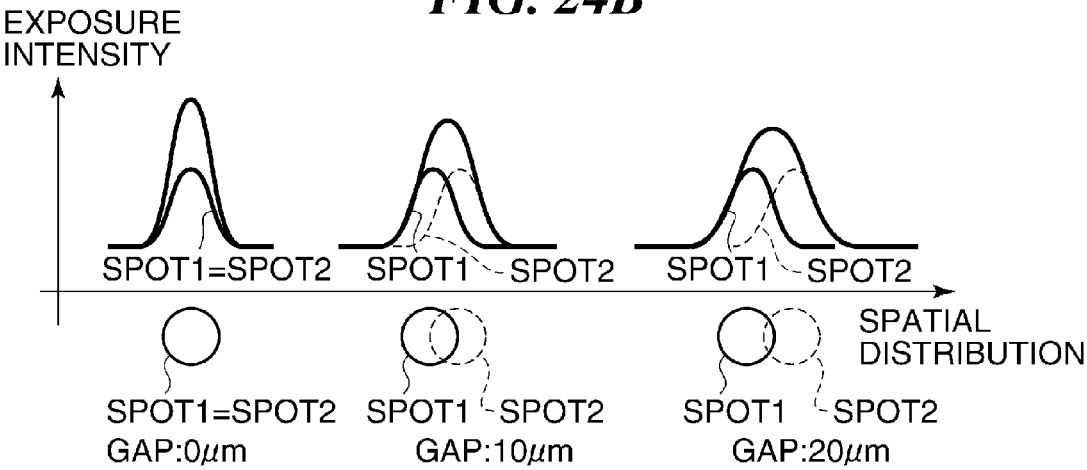
FIG. 24B is a view showing variation of an exposure profile depending on a gap between centers of exposure spots.

FIG. 24B is a view showing variation of the exposure profile depending on the gap Δ between centers of exposure spots by the two laser beams. FIG. 24B shows simulation results of the exposure profiles where the gaps Δ between the centers of the exposure spots are 0 μm (no gap), 10 μm, and 20 μm. A vertical axis denotes exposure intensity and a horizontal axis denotes spatial distribution to show the gap Δ.

Figure 24C:
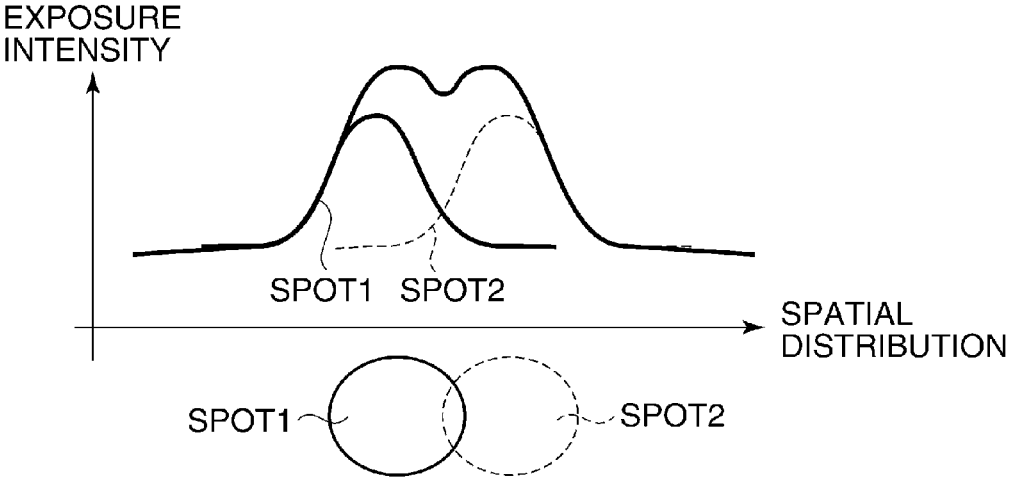
FIG. 24C is a view showing the exposure profile having two peaks when the gap between the centers of the exposure spots is large.
Figure 25:
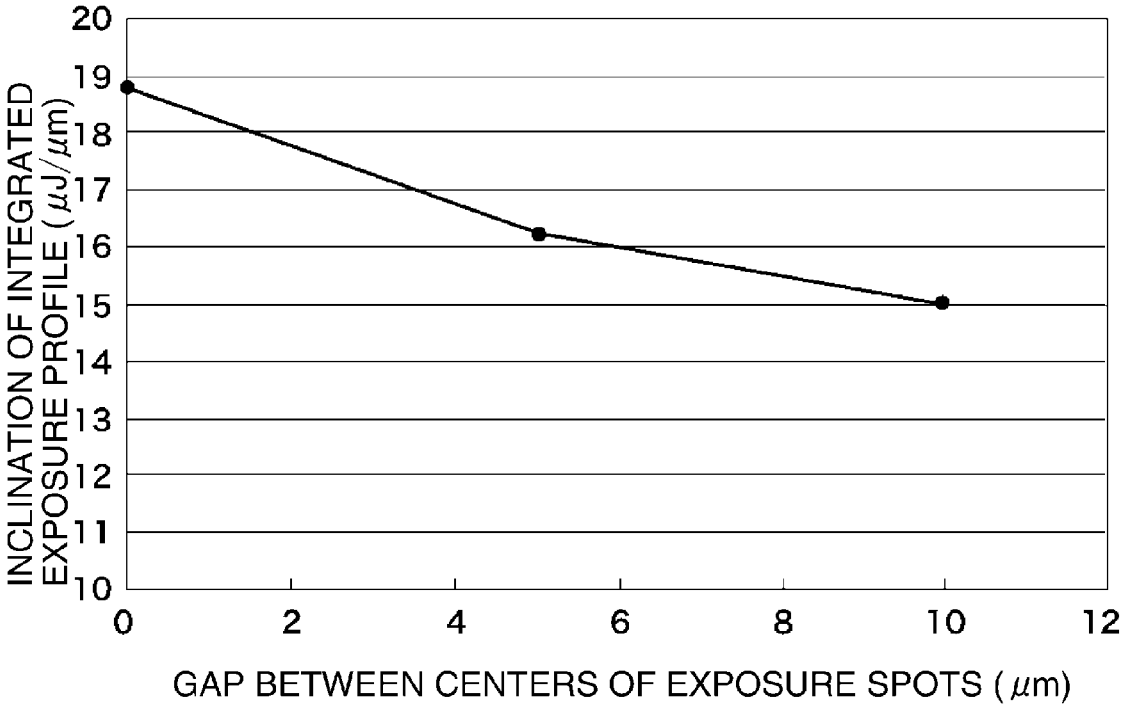
FIG. 25 is a graph showing relation between the gap between the centers of the exposure spots and the inclination of the exposure profile.

Although an exposure profile when the centers of two exposure spots are shifted is not Gaussian, the inclination at the exposure intensity of $1/e^2$ to the peak light amount of each exposure spot is shown in FIG. 25 for comparison. As shown in FIG. 24B and FIG. 25, the inclination at the exposure intensity of $1/e^2$ and the peak light amount can be decreased by increasing the gap Δ between the centers of the exposure spots. However, when the gap Δ between the centers of the exposure spots becomes too large, the exposure profile will have two peaks as shown in FIG. 24C. Caution is required. According to such a simulation, when the exposure spot diameter is 40 μm, two peaks do not appear in the exposure profile when the gap Δ between the centers of the exposure spots does not exceed 25 μm. Therefore, the gap between the centers of the exposure spots is set so as not to exceed 25 μm in the second embodiment.

As with the first embodiment, in order to investigate effect of the shifting of the centers of the exposure spots on the latent image profile, simulation results of the latent profiles will be described. As the gap Δ between the centers of the exposure spots, three conditions of 0 μm (no gap), 10 μm, and 20 μm, are set, and the photoconductor thickness is set to be 25 μm as an initial value. In the simulation, the exposing condition is set so that the contrast electric potential in the solid black area that is formed by the exposure profile of one dot formed by two laser beams becomes constant.

Figure 26:
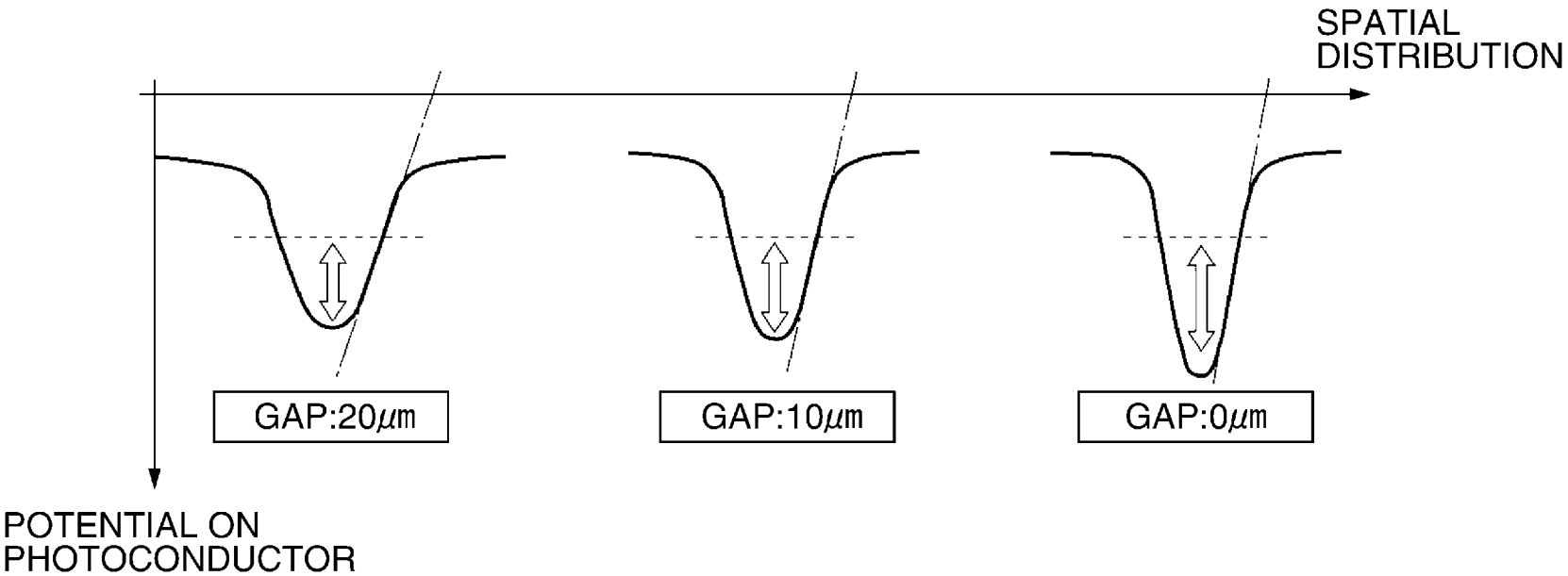
FIG. 26 is a view showing variation of the latent image profile depending on the gap between centers of the exposure spots.
Figure 27A:
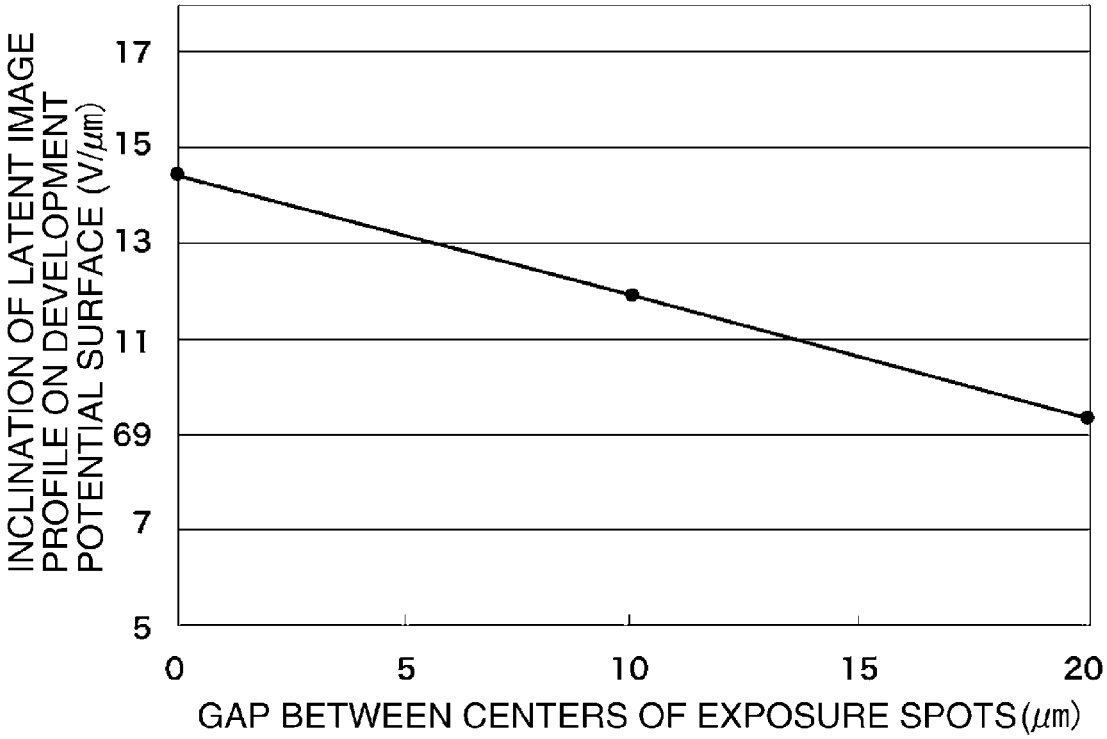
FIG. 27A is a graph showing relation between the inclination of the latent image profile on the development potential surface, which is obtained from the latent image profile in FIG. 26, and the gap between the centers of the exposure spots.
Figure 27B:
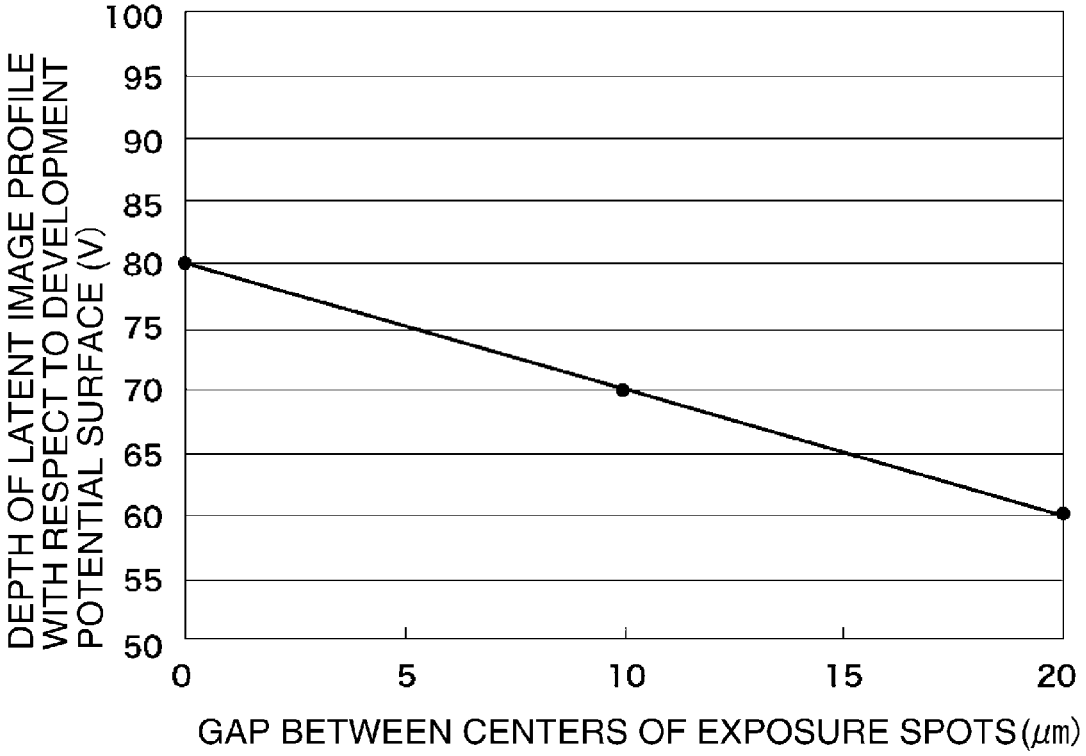
FIG. 27B is a graph showing relation between depth of the latent image profile with respect to the development potential surface and the gap between the centers of the exposure spots.

FIG. 26 is a view showing variation of the latent image profile according to the gap Δ between the centers of the exposure spots. A vertical axis denotes electric potential. FIG. 26 shows simulation results of the latent image profiles where the gaps Δ between the centers of the exposure spots are 0 μm, 10 μm, and 20 μm. FIG. 27A is a graph showing relation between the inclination of the latent image profile on the development potential surface, which is obtained from the latent image profile in FIG. 26, and the gap Δ between the centers of the exposure spots. FIG. 27B is a graph showing relation between the depth of the latent image profile with respect to the development potential surface, which is obtained from the latent image profile in FIG. 26, and the gap Δ between the centers of the exposure spots.

As shown in FIG. 27A and FIG. 27B, when the gap Δ between the centers of the exposure spots increases, the inclination of the latent image profile on the development potential surface becomes smaller and the depth of the latent image with respect to the development potential surface becomes shallower. Thus, the variation of the gap between the centers of the exposure spots has the same effect as the variation of the exposure spot diameter of a single laser beam on the inclination of the latent image profile on the development potential surface and the depth with respect to the development potential surface.

When exposing by one laser beam using pulse width modulation, pulse width can be changed without changing light amount to one dot by changing both of the pulse width and the laser intensity, which gives the same effect as to change the exposure spot diameter. It should be noted that laser intensity is dropped when the pulse width of laser beam is expanded.

Thus, the graininess can be optimized by changing the exposure spot area to obtain the necessary height of toner image regardless of the method of changing the exposure profile. The method of changing the exposure profile by two laser beams is not accompanied by the mechanical operation of the collimator lens 33 like the first embodiment, but changes the exposure profile with image data or an electrical signal. Accordingly, the exposure profile can be easily changed in the imaging area even under a high process speed.

A third embodiment is different from the first embodiment in a test pattern for measuring the graininess, and other configurations are the same as those of the first embodiment. Therefore, the test pattern will be described in detail hereafter.

When the test patterns are created with one kind of image pattern like the first embodiment, the average density of the image pattern may vary owing to variation of an image forming process condition, etc. even if the gradation is set so as to keep the average density constant. In that case, the height of toner image is optimized by the graininess of another density level instead of a density level that is set as a standard (a standard density level). That is, since the value of graininess generally varies with the density level, the height of toner image for keeping the good graininess of the standard density level may differ from the optimal height of toner image (exposure spot diameter) obtained from the RMS granularity measurement of the test pattern.

Figure 28A:
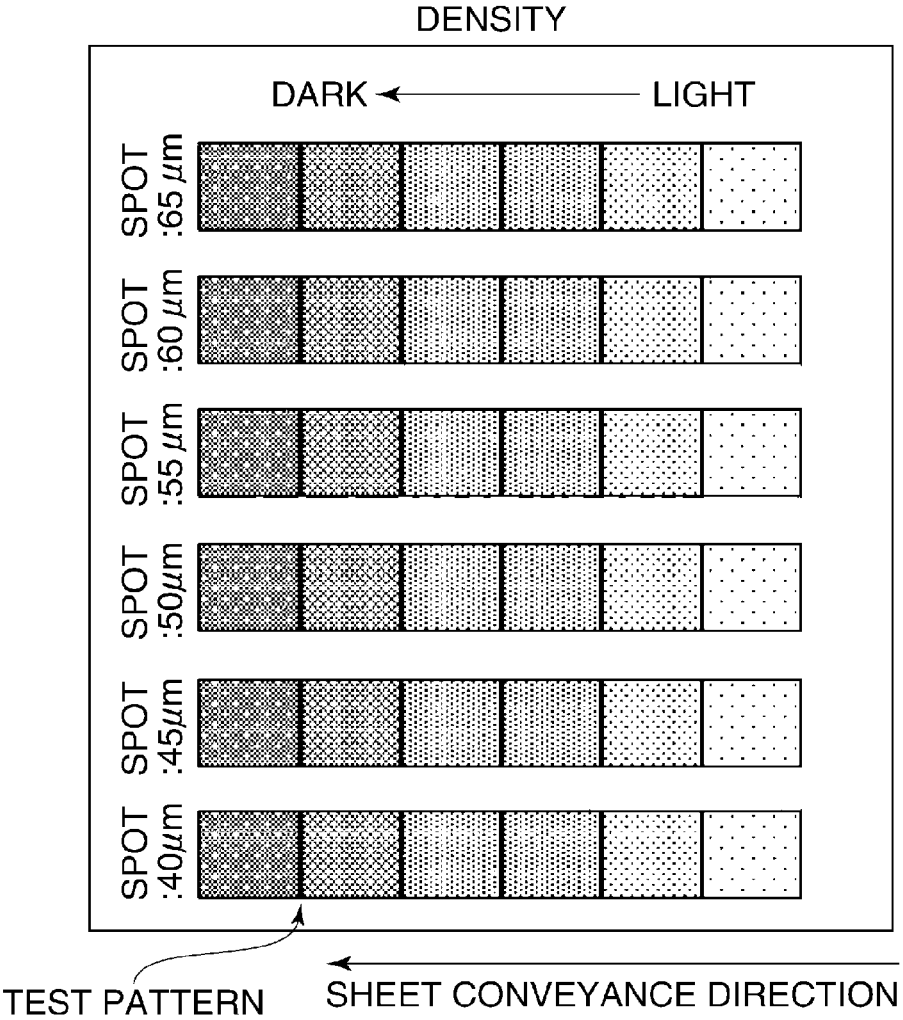
FIG. 28A is a view showing examples of test patterns for graininess measurement used in a third embodiment.

FIG. 28A is a view showing examples of test patterns for the graininess measurement used in the third embodiment. In this example, six pattern lines corresponding to the measurements of the exposure spot diameters are arranged. Each of the pattern lines comprises six image patterns of different density levels. It should be noted that the number of pattern lines is not limited to six and the number of image patterns per pattern line is not limited to six. The screen ruling of the test patterns in FIG. 28A is 150 lpi that is used for image formation, and the density levels are changed by area gradation.

In order to detect the graininess using the test patterns in FIG. 28A, the test patterns in FIG. 28A are first outputted (printed) onto a recording sheet (a sheet of an A4 size) in the same manner as that in the first embodiment. Subsequently, image information is read by the reader 11 for every gradation pattern, and the RMS granularity and the average density for every gradation pattern are calculated by the central arithmetic unit 64.

Figure 28B:
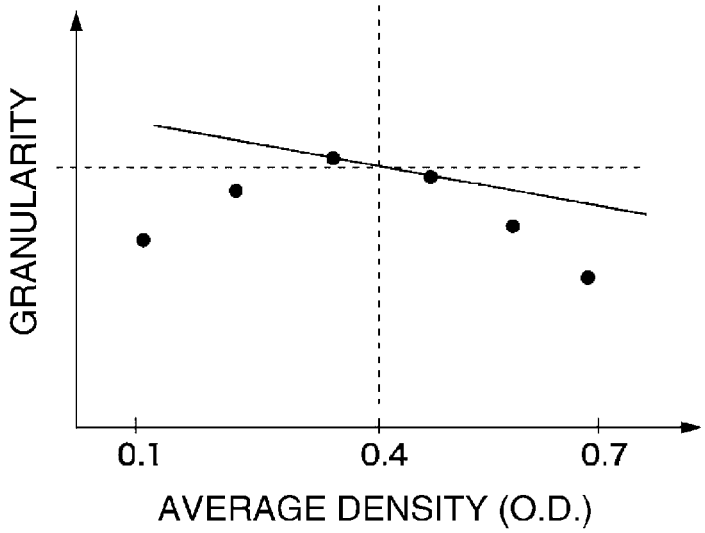
FIG. 28B is a graph showing relation between the RMS granularity of the image pattern corresponding to a certain exposure spot diameter and average density.

FIG. 28B is a graph showing relation between the RMS granularity of the image pattern corresponding to a certain exposure spot diameter and average density. Each point indicated by a black dot corresponds to each gradation pattern. Two points of gradations of which average densities are the nearest to the standard density 0.4 (O. D.) are selected. The selected two points are joined by a straight line. The value of the granularity at the intersection of the obtained straight line and the density 0.4 (O. D.) shall be a value of the graininess in this exposure spot diameter. This process is performed by the CPU 64 of the controller 12.

Thus, according to the third embodiment, the granularity is calculated based on the granularities of the image patterns of different density levels even if the density of the outputted image varies owing to variation of an image forming process condition, etc. Accordingly, the height of toner image is optimized so that the graininess of the standard density level is always kept good.

Next, a fourth embodiment will be described. The first embodiment automatically sets the optimal exposure spot diameter according to the graininess that is found for every exposure spot diameter (the height of toner image) based on the test patterns (see FIG. 7) outputted to the recording sheet. On the other hand, in the fourth embodiment, a user can select an exposure spot diameter (the height of toner image) from the output results of test patterns, and other configurations are the same as those of the first embodiment.

Figure 29A:
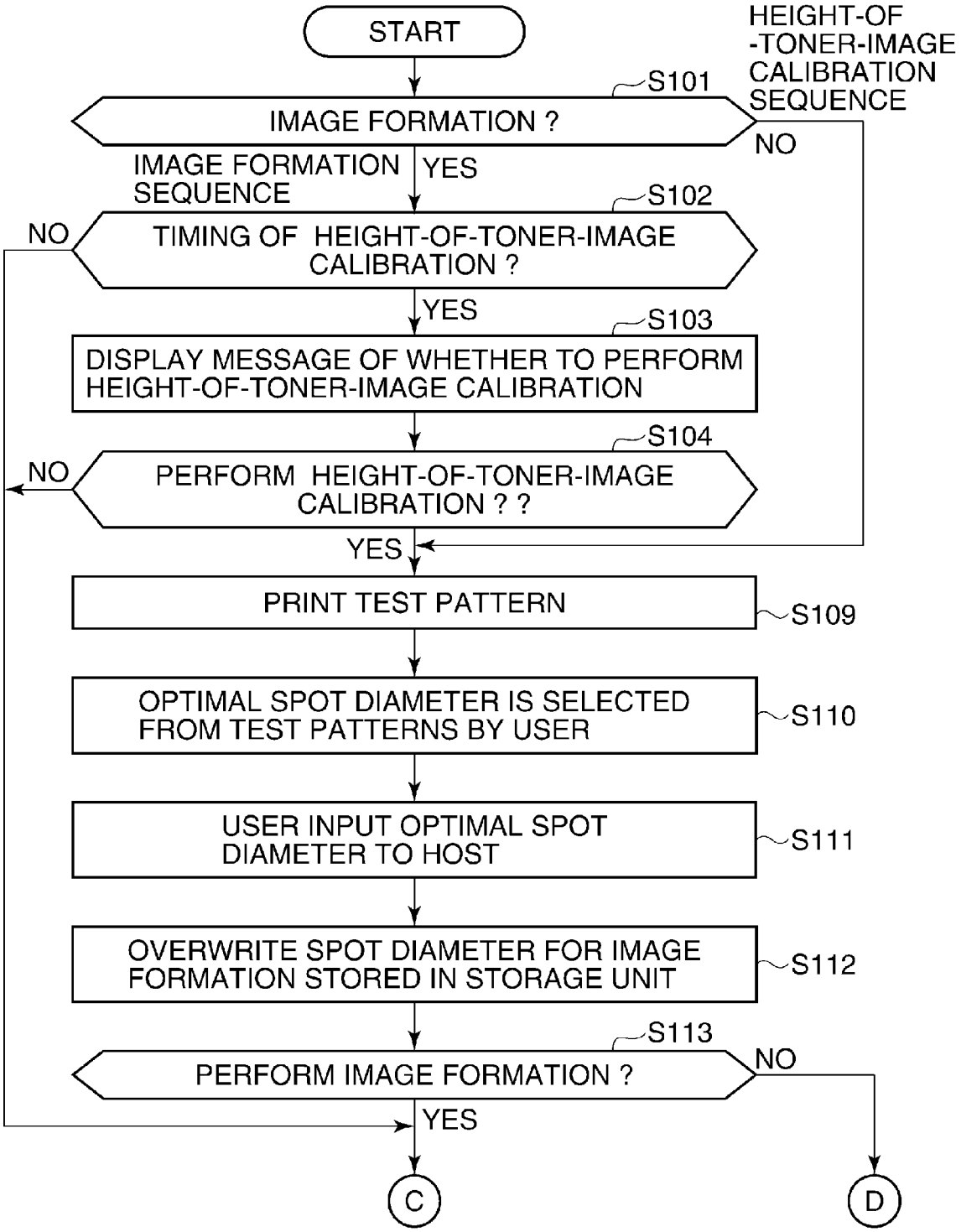
FIG. 29A and FIG. 29B are flowcharts showing an image forming method according to a fourth embodiment.
Figure 29B:
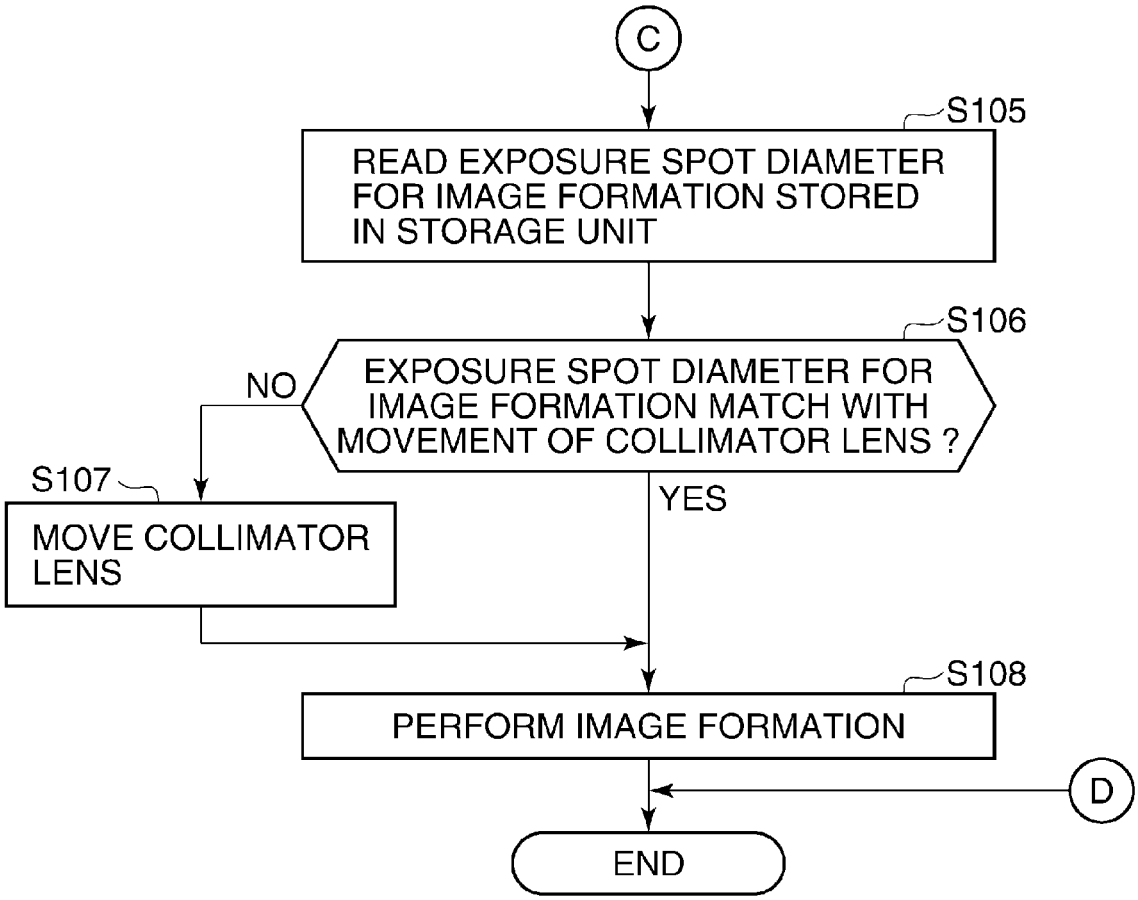

FIG. 29A and FIG. 29B are flowcharts showing an image forming method according to the fourth embodiment. Since the hardware configuration of the image forming apparatus according to the fourth embodiment is the same as that of the image forming apparatus according to the first embodiment as above-mentioned, the block diagram in FIG. 20 is referred to suitably in the following description.

When a user operates the image forming apparatus to input a print signal or a height-of-toner-image calibration start signal to the host 61, the controller 12 determines whether the input signal is a print signal (step S101). When the input signal is a print signal (YES in the step S101), the controller 12 proceeds with the process to an image formation sequence. When the input signal is not a print signal (NO in the step S101, i.e., when it is a height-of-toner-image calibration start signal), the controller 12 proceeds with the process to a height-of-toner-image calibration sequence.

Since the process in steps S102 through S108, which is the image formation sequence, is the same as that in the steps S002 through S008 that is the image formation sequence described with reference to FIG. 21A and FIG. 21B, description here is omitted. Next, the height-of-toner-image calibration sequence will be described.

In the height-of-toner-image calibration sequence, the test patterns are outputted first (step S109). The test patterns shown in FIG. 7 are used, and the patterns are printed in the imaging area of an A4 sheet as a recording sheet while changing the exposure spot diameter. Subsequently, the optimal exposure spot diameter is selected from the images of the outputted test patterns by the user (step S110). On the occasion of the selection of the optimal exposure spot diameter, the user may select the diameter of which the graininess is visually determined as the optimal by the user, may select the diameter with another evaluation technique of the graininess, and is not limited in particular.

Next, the optimal exposure spot diameter that is determined by the user is inputted to the host 61 (step S111). In this way, the value of the exposure spot diameter for image formation currently recorded in the storage unit 65 is overwritten with the value of the exposure spot diameter inputted to the host 61 (step S112). Then, the controller 12 determines whether the signal first inputted into the host 61 has been a print signal with reference to the storage unit 65 (step S113). When it is a print signal (YES in the step S113), the process proceeds to the step S105. When it is not a print signal, i.e., when it is a height-of-toner-image calibration signal (NO in the step S113), the process is finished.

The image quality required by the user is able to be maintainable by selecting the optimal height of toner image (exposure spot diameter) from the images of the outputted test patterns by the user's selection like the fourth embodiment.

As mentioned above, the image forming apparatuses and the image forming methods according to the embodiments of the present invention set a height of toner image that constitutes one dot of a halftone to the optimal height of toner image for an environmental condition or an endurance condition. Accordingly, even if the environmental condition or the endurance condition varies, the graininess of an outputted image can be kept good. Since the height of toner image is optimized based on the images of the outputted test patterns, the height of toner image on the photoconductor 1 can be optimized without reading it by a sensor etc., which enables to optimize the height of toner image with a simple configuration.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-025885, filed on Feb. 9, 2011, which is hereby incorporated by reference herein in its entirety.

What is claimed is:

1. An image forming apparatus comprising:

a photoconductor;

an exposure unit configured to expose said photoconductor to a light beam to form an electrostatic latent image on said photoconductor;

a development unit configured to develop the electrostatic latent image with a toner;

a change unit configured to change a height of toner image formed on a surface of said photoconductor by changing an exposure spot area of the light beam on the surface of said photoconductor;

a formation unit configured to control said exposure unit, said development unit, and said change unit so that a plurality of test patterns, corresponding to different exposure spot areas respectively, are formed on a recording sheet;

a read unit configured to read the plurality of test patterns formed on the recording sheet; and a control unit configured to detect graininess of each of the plurality of test patterns based on information about the plurality of test patterns read by said read unit, to determine an exposure spot area where the graininess becomes good relatively, and to control the height of toner image on the photoconductor by setting the exposure spot area determined so as to be an exposure spot area for image formation.

2. The image forming apparatus according to claim 1, wherein said change unit changes the exposure spot area by adjusting convergence of the light beam for exposure emitted from said exposure unit.

3. The image forming apparatus according to claim 1, wherein said exposure unit has a plurality of light sources that emit light beams, and wherein said change unit changes the exposure spot area on the surface of said photoconductor by adjusting gaps between centers of exposure spots formed by the light beams emitted from the light sources on the surface of said photoconductor by a first scan and centers of exposure spots formed by the light beams emitted from the light sources on the surface of said photoconductor by a second scan so as to be overlapped with the exposure spots by the first scan.

4. The image forming apparatus according to claim 1, wherein said exposure unit has a pulse width modulation unit, and wherein said change unit changes the exposure spot area by changing pulse width by the pulse width modulation unit.

5. The image forming apparatus according to claim 1, wherein the plurality of test patterns are formed to arrange the same image patterns and the number of the plurality of test patterns is equal to measurement points for the exposure spot area.

6. The image forming apparatus according to claim 1, wherein the plurality of test patterns are formed to arrange the same pattern lines each of which has image patterns of different density levels and the number of pattern lines is equal to measurement points for the exposure spot area.

7. The image forming apparatus according to claim 1, wherein the plurality of test patterns are formed within an imaging range of a single sheet of a predetermined size as the recording sheet.

8. The image forming apparatus according to claim 1, wherein the plurality of test patterns are printed while changing the exposure spot area in an imaging range.

9. An image forming method executed in an image forming apparatus that is provided with a photoconductor, an exposure unit that exposes the photoconductor to a light beam to form an electrostatic latent image on the photoconductor, and a development unit that develops the electrostatic latent image with a toner, the image forming method comprising:

a formation step of controlling the exposure unit and the development unit so that a plurality of test patterns, corresponding to different exposure spot areas respectively, are formed on a recording sheet;

a read step of reading the plurality of test patterns formed on the recording sheet in said formation step;

a detection step of detecting graininess of each of the test patterns read in said read step; and a control step of determining an exposure spot area where the graininess becomes good relatively, and controlling a height of toner image formed on a surface of the photoconductor at the time of image formation by setting the exposure spot area determined so as to be an exposure spot area for image formation.

* * * * *